US011179955B2

(12) United States Patent
Yamasaki et al.

(10) Patent No.: US 11,179,955 B2
(45) Date of Patent: Nov. 23, 2021

(54) CLEANING DEVICE AND IMAGE FORMING APPARATUS INCLUDING THE SAME

(71) Applicant: KYOCERA Document Solutions Inc., Osaka (JP)

(72) Inventors: Shunsuke Yamasaki, Osaka (JP); Shinobu Ohata, Osaka (JP); Naoto Miyakoshi, Osaka (JP); Hiroatsu Tamai, Osaka (JP); Yasuhiro Michishita, Osaka (JP); Takeshi Watanabe, Osaka (JP); Kenichi Satake, Osaka (JP); Hiroki Sakane, Osaka (JP); Masato Usui, Osaka (JP); Yuzuru Yuasa, Osaka (JP); Yusuke Tamekuni, Osaka (JP)

(73) Assignee: KYOCERA Document Solutions Inc.

( * ) Notice: Subject to any disclaimer, the term of this patent is extended or adjusted under 35 U.S.C. 154(b) by 0 days.

(21) Appl. No.: 16/885,422

(22) Filed: May 28, 2020

(65) Prior Publication Data

US 2020/0376867 A1 Dec. 3, 2020

(30) Foreign Application Priority Data

May 30, 2019 (JP) ..... JP2019-101698
Sep. 26, 2019 (JP) ..... JP2019-175340

(51) Int. Cl.
*B41J 29/17* (2006.01)
*B41J 11/04* (2006.01)

(52) U.S. Cl.
CPC ..... *B41J 29/17* (2013.01); *B41J 11/04* (2013.01)

(58) Field of Classification Search
CPC ..... B41J 29/17; B41J 11/04; B08B 1/008; G03G 2215/0054; G03G 21/12;
(Continued)

(56) References Cited

U.S. PATENT DOCUMENTS 5,991,568 A * 11/1999 Ziegelmuller ..... G03G 21/007 399/102
9,405,238 B2 * 8/2016 Hatazaki ..... G03G 15/2025
(Continued)

FOREIGN PATENT DOCUMENTS

JP 49-12671 3/1974
JP 10-129874 * 5/1998 ..... B65H 5/00
(Continued)

OTHER PUBLICATIONS

Machine translation of JP 2006-117420, published May 2006.*
(Continued)

*Primary Examiner* — Huan H Tran
(74) *Attorney, Agent, or Firm* — Gerald E. Hespos; Michael J. Porco; Matthew T. Hespos

(57) ABSTRACT

The cleaning device includes a cleaning unit. The cleaning unit includes a cleaning part having a contact surface brought into contact with a surface of a conveyance roller to clean the surface of the conveyance roller, and a housing that supports the cleaning part. The cleaning part includes a web of a strip shape, the web forming the contact surface that comes in contact with the conveyance roller, a pressing roller that presses the web against the conveyance roller, a feed-out roller that feeds out the web so as to cause a part of the web that comes in contact with the conveyance roller to shift, and a take-up roller that takes up the web. The housing has an opening that receives foreign matter dropping from the vicinity of a nip portion formed between the pressing roller and the conveyance roller.

7 Claims, 22 Drawing Sheets

(58) Field of Classification Search
CPC ..... G03G 2215/00679; G03G 2215/00708; G03G 21/169; G03G 21/00; G03G 15/6529; G03G 21/0058; G03G 21/007; B65H 2301/531; B65H 5/06
See application file for complete search history.

(56) References Cited

U.S. PATENT DOCUMENTS

| | | | | |
|---|---|---|---|---|
| 2004/0120728 | A1* | 6/2004 | Ziegelmuller | G03G 21/0011 399/123 |
| 2004/0156650 | A1* | 8/2004 | Ziegelmuller | G03G 21/0011 399/102 |
| 2009/0092429 | A1* | 4/2009 | Yokota | G03G 21/007 399/360 |
| 2012/0082495 | A1 | 4/2012 | Ichikawa et al. | |
| 2015/0001791 | A1 | 1/2015 | Fukunaga | |
| 2016/0209776 | A1* | 7/2016 | Akaike | G03G 21/12 |

FOREIGN PATENT DOCUMENTS

| | | | | |
|---|---|---|---|---|
| JP | 11-296013 | | 10/1999 | |
| JP | 2002-154699 | * | 5/2002 | B65H 5/00 |
| JP | 2002-316738 | * | 10/2002 | B65H 5/00 |
| JP | 2004-345805 | | 12/2004 | |
| JP | 2006-117420 | | 5/2006 | |
| JP | 2010-253823 | * | 11/2010 | B41J 3/04 |
| JP | 2014-008763 | * | 1/2014 | B41J 2/165 |
| WO | 2019-058975 | | 3/2019 | |

OTHER PUBLICATIONS

Machine translation of JP 2003-345805, published Dec. 2004.*
Google translation of WO2019058795., published Mar. 2019.*
Machine translation of JP 2014-008763, published on Jan. 2014.*
Machine translation of JP 2010-253823, published on Nov. 2010.*
Extended European Search Report dated Oct. 6, 2020.

* cited by examiner

CLEANING DEVICE AND IMAGE FORMING APPARATUS INCLUDING THE SAME

INCORPORATION BY REFERENCE

This application is based on Japanese Patent Application No. 2019-101698 filed with the Japanese Patent Office on May 30, 2019 and Japanese Patent Application No. 2019-175340 filed with the Japanese Patent Office on Sep. 26, 2019, the contents of which are incorporated by reference.

BACKGROUND

Field of the Invention

The present disclosure relates to a cleaning device which cleans a conveyance roller that conveys a sheet, and an image forming apparatus including the cleaning device.

Related Art

In an image forming apparatus such as a printer, a sheet is conveyed to a predetermined image forming position, and an image is formed on the sheet at the image forming position. Generally, a pair of resist rollers feeds out a sheet to the image forming position. The pair of resist rollers each has a length corresponding to a width of the sheet, and forms a nip portion through which the sheet passes. When a distal end portion of the sheet is brought into contact with the nip portion in a state where the rotation of the pair of resist rollers is stopped, skewing of the sheet is straightened. Afterward, when the pair of resist rollers rotates, the sheet is conveyed into the nip portion and then is fed out from there at proper timing matching timing of image forming at the image forming position.

Conventionally, there has been known a cleaning device which removes paper dust adhering to a surface of each resist roller. The cleaning device includes a rolled web, and a pressing roller that presses the web against a surface of the resist rollers. The web is fed out sequentially, and, consequently, a new part of the web surface comes in contact with the surface of the resist roller, thus removing paper dust therefrom.

SUMMARY

A cleaning device according to an aspect of the present disclosure is capable of cleaning a surface of a conveyance roller that conveys a sheet in an image forming apparatus. The cleaning device includes a cleaning unit. The cleaning unit includes a cleaning part having a contact surface extending along an axial direction of the conveyance roller, the contact surface being brought into contact with the surface of the conveyance roller to clean the surface of the conveyance roller, and a housing that supports the cleaning part.

The cleaning part includes a web of a strip shape, the web forming the contact surface that comes in contact with the conveyance roller, a pressing roller that presses the web against the conveyance roller, a feed-out roller that feeds out the web so as to cause a part of the web that comes in contact with the conveyance roller to shift, and a take-up roller that takes up the web. The housing has a box structure having an opening that receives foreign matter dropping from a vicinity of a nip portion formed between the pressing roller and the conveyance roller.

An image forming apparatus according to another aspect of the present disclosure includes an apparatus body, a conveyance roller that conveys a sheet, an image forming unit that forms an image on the sheet, and the cleaning device capable of cleaning the conveyance roller.

DETAILED DESCRIPTION

[Overall Structure of Image Forming Apparatus]

Figure 1:
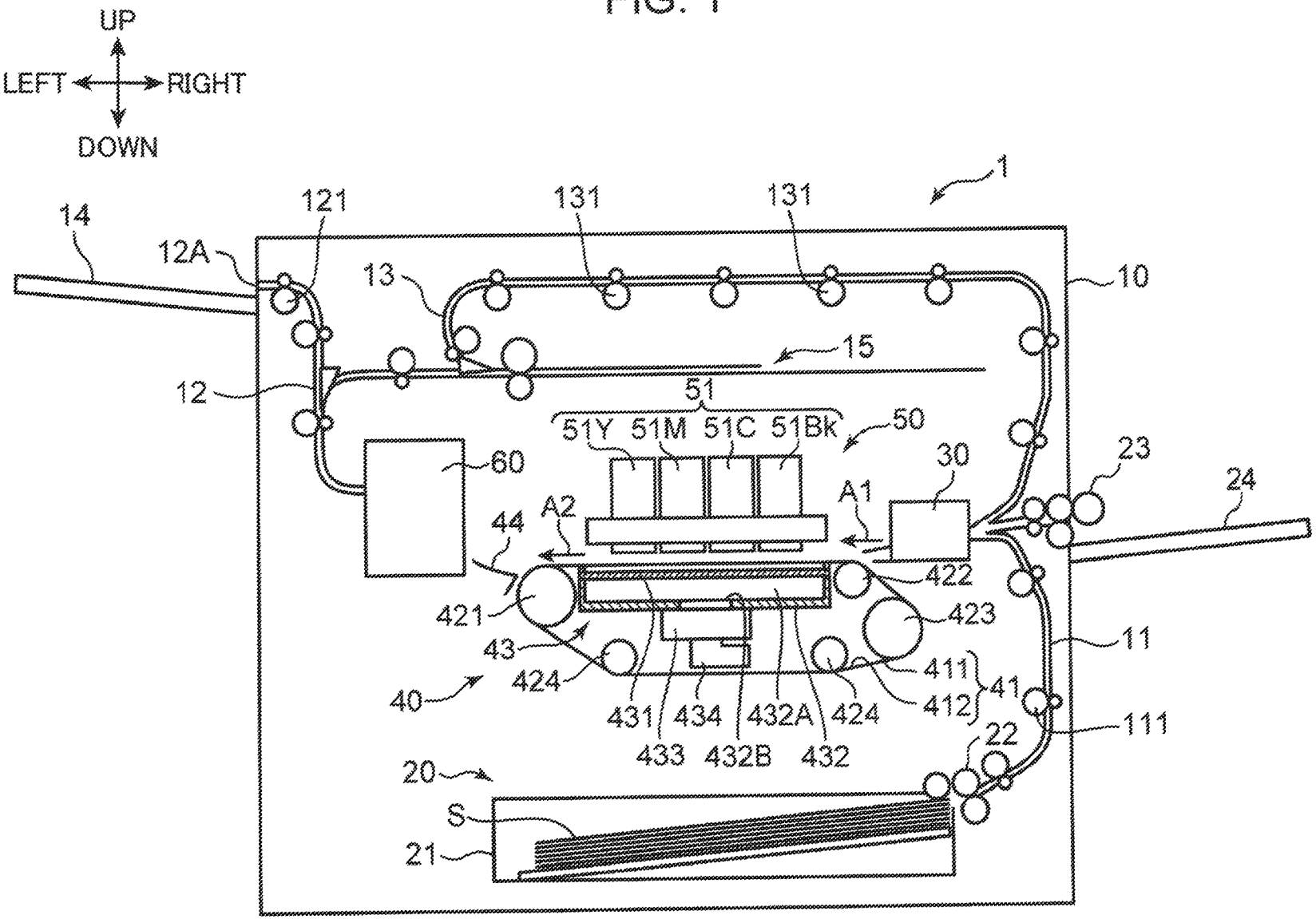
FIG. 1 is a schematic cross-sectional view showing an internal structure of an image forming apparatus according to an embodiment of the present disclosure.

An embodiment of the present disclosure will hereinafter be described with reference to the drawings. FIG. 1 is a schematic cross-sectional view showing an internal structure of an image forming apparatus 1 according to the embodiment of the present disclosure. The image forming apparatus 1 is an ink jet printer that forms an image on a sheet S by ejecting ink droplets. The image forming apparatus 1 includes an apparatus body 10, a paper supply unit 20, a resist roller unit 30, a belt conveyance unit 40, an image forming unit 50, and a curl correction unit 60.

The apparatus body 10 is a box-shaped housing that houses various devices for forming an image on the sheet S. In the apparatus body 10, a first conveyance path 11, a second conveyance path 12, and a third conveyance path 13 each serving as a conveyance path of the sheet S are formed.

The paper supply unit 20 supplies the sheet S to the first conveyance path 11. The paper supply unit 20 includes a paper supply cassette 21 and a paper supply roller 22. The paper supply cassette 21 is detachably mounted on the apparatus body 10 and sheets S are stored in the paper supply cassette 21. The paper supply roller 22 is disposed on a right side of an upper end portion of the paper supply cassette 21. The paper supply roller 22 conveys the sheet S stored in the paper supply cassette 21 to a downstream side of the first conveyance path 11.

The sheet S supplied to the first conveyance path 11 is conveyed to the resist roller unit 30 disposed on a downstream end of the first conveyance path 11 by a pair of first conveyance rollers 111 disposed on the first conveyance path 11. On a right side surface of the apparatus body 10, a paper supply tray 24 is disposed. Sheets S can be placed manually on an upper surface of the paper supply tray 24. The sheets S placed on the paper supply tray 24 are fed out toward the resist roller unit 30 by the paper supply roller 23.

The resist roller unit 30 is a device that conveys the sheet S, which is conveyed through the first conveyance path 11 or the paper supply roller 23, toward a conveyance belt 41 (conveyance portion) of the belt conveyance unit 40 in a sheet conveyance direction A1. The resist roller unit 30 and the belt conveyance unit 40 are at different locations at which they each convey the sheet S. Details of the resist roller unit 30 are described later.

The sheet S conveyed by the resist roller unit 30 is conveyed by the belt conveyance unit 40 in a sheet conveyance direction A2. The sheet conveyance directions A1 and A2 are leftward directions in FIG. 1.

The belt conveyance unit 40 is disposed below the image forming unit 50. The belt conveyance unit 40 conveys the sheet S, which is conveyed by the resist roller unit 30 to travel under the image forming unit 50, in the sheet conveyance direction A2 toward the curl correction unit 60. The belt conveyance unit 40 has a conveyance belt 41, a first support roller 421, a second support roller 422, a third support roller 423, a pair of fourth support rollers 424, and a suction unit 43.

The conveyance belt 41 is an endless belt having a predetermined width in a front-rear direction and extending in a left-right direction. The conveyance belt 41 is disposed so as to face the image forming unit 50, and conveys the sheet S in the sheet conveyance direction A2 on an outer peripheral surface 411. An image forming position where an image is formed on the sheet S by the image forming unit 50 is set on an orbital movement path of the conveyance belt 41.

The conveyance belt 41 is supported in an extended manner between and by the first support roller 421, the second support roller 422, the third support roller 423, and the pair of fourth support rollers 424. The suction unit 43 is disposed inside the conveyance belt 41 which is supported in an extended manner as described above in a state where the suction unit 43 faces an inner peripheral surface 412 of the conveyance belt 41. The first support roller 421 is rotatably driven by a drive motor (not shown), and allows the conveyance belt 41 to orbit in a predetermined orbital direction. The conveyance belt 41 has a plurality of suction holes penetrating the conveyance belt 41 in its thickness direction from the outer peripheral surface 411 to the inner peripheral surface 412.

The suction unit 43 is disposed so as to face the image forming unit 50 with the conveyance belt 41 interposed therebetween. The suction unit 43 brings the sheet S into close contact with the outer peripheral surface 411 of the conveyance belt 41 by generating a negative pressure between the sheet S held on the outer peripheral surface 411 of the conveyance belt 41 and the conveyance belt 41. The suction unit 43 includes a belt guide member 431, a suction housing 432, a suction device 433, and an exhaust duct 434.

The belt guide member 431 guides the orbital movement of the conveyance belt 41 in an interlocking manner with the rotation of the first support roller 421 between the first support roller 421 and the second support roller 422. The belt guide member 431 has a groove portion and a through-hole. The suction unit 43 sucks air from a space above the conveyance belt 41 through the groove portion and through-hole of the belt guide member 431 and through the suction holes of the conveyance belt 41. A suction force resulting from this process generates an airflow (suction air) in the space above the conveyance belt 41, the airflow heading toward the suction unit 43. When the sheet S is conveyed by the resist roller unit 30 onto the conveyance belt 41 and covers a part of the outer peripheral surface 411 of the conveyance belt 41, a suction force (negative pressure) acts on the sheet S, bringing the sheet S into close contact with the outer peripheral surface 411 of the conveyance belt 41.

The suction housing 432 is a box-shaped housing having an upper opening, and the suction housing 432 is disposed below the conveyance belt 41 such that the upper opening is covered by the belt guide member 431. The suction housing 432 defines a suction space 432A in cooperation with the belt guide member 431. An opening portion 432B is formed in a bottom wall portion of the suction housing 432, and the suction device 433 is disposed corresponding to the opening portion 432B. The exhaust duct 434 is connected to the suction device 433. The exhaust duct 434 is connected to an exhaust port (not shown) formed on the apparatus body 10.

The image forming unit 50 is disposed above the belt conveyance unit 40. The image forming unit 50 forms an image by applying image forming processing to the sheet S which is conveyed in the sheet conveyance direction A2 in a state where the sheet S is held on the outer peripheral surface 411 of the conveyance belt 41. In the this embodiment, an image forming method of the image forming unit 50 is an ink jet method, and an image is formed on the sheet S by ejecting ink droplets.

The image forming unit 50 includes line heads 51 (51Bk, 51C, 51M, 51Y). The line head 51Bk ejects black ink droplets, the line head 51C ejects cyan ink droplets, the line head 51M ejects magenta ink droplets, and the line head 51Y ejects yellow ink droplets. The line heads 51Bk, 51C, 51M, and 51Y are arranged adjacent to each other from an upstream side to a downstream side in the sheet conveyance direction A1. Each of the line heads 51Bk, 51C, 51M, and 51Y ejects ink droplets on the sheet S conveyed in the sheet conveyance direction A2 in a state where the sheet S is held on the outer peripheral surface 411 of the conveyance belt 41, thereby forming an image on the sheet S. As a result, an image is formed on the sheet S.

The sheet S on which the image is formed is conveyed by the conveyance belt 41, and is guided by a sheet discharge guide unit 44 to enter the curl correction unit 60. The curl correction unit 60 is disposed downstream to the conveyance belt 41 in the sheet conveyance direction A2 across the sheet discharge guide unit 44. The curl correction unit 60 corrects the curl of the sheet S on which the image is formed while conveying the sheet S to the downstream side.

The sheet S whose curl has been corrected by the curl correction unit 60 is fed out to the second conveyance path 12. The second conveyance path 12 extends along a left side surface of the apparatus body 10. The sheet S fed out to the second conveyance path 12 is conveyed by a pair of second conveyance rollers 121 disposed on the second conveyance path 12 toward a paper discharge port 12A formed on a left side of the apparatus body 10, and the sheet S is discharged onto a paper discharge unit 14 from the paper discharge port 12A.

In a case where both-side printing is applied to the sheet S, meanwhile, the sheet S, whose front surface has been subjected to the image forming processing, is fed out from the second conveyance path 12 toward a sheet reversing unit 15. The sheet reversing unit 15 is a conveyance path branching out from a midpoint of the second conveyance path 12, serving as a part where the sheet S is reversed in surface position and conveyance direction (switchback). The sheet S reversed by the sheet reversing unit 15 to have its front and back surfaces switched to each other is fed out to a third conveyance path 13, on which the sheet S is conveyed in a reverse direction by a pair of third conveyance rollers 131 disposed on the third conveyance path 13. Subsequently, the sheet S travels through the resist roller unit 30 and is re-supplied onto the outer peripheral surface 411 of the conveyance belt 41 in a state where the sheet S is reversed to have its front and back surfaces switched to each other. The re-supplied sheet S is conveyed by the conveyance belt 41 as the image forming processing is applied to the back surface of the sheet S by the image forming unit 50. The sheet S on which both-side printing has been completed passes through the second conveyance path 12, and is discharged onto the paper discharge unit 14 from the paper discharge port 12A.

Figure 2:
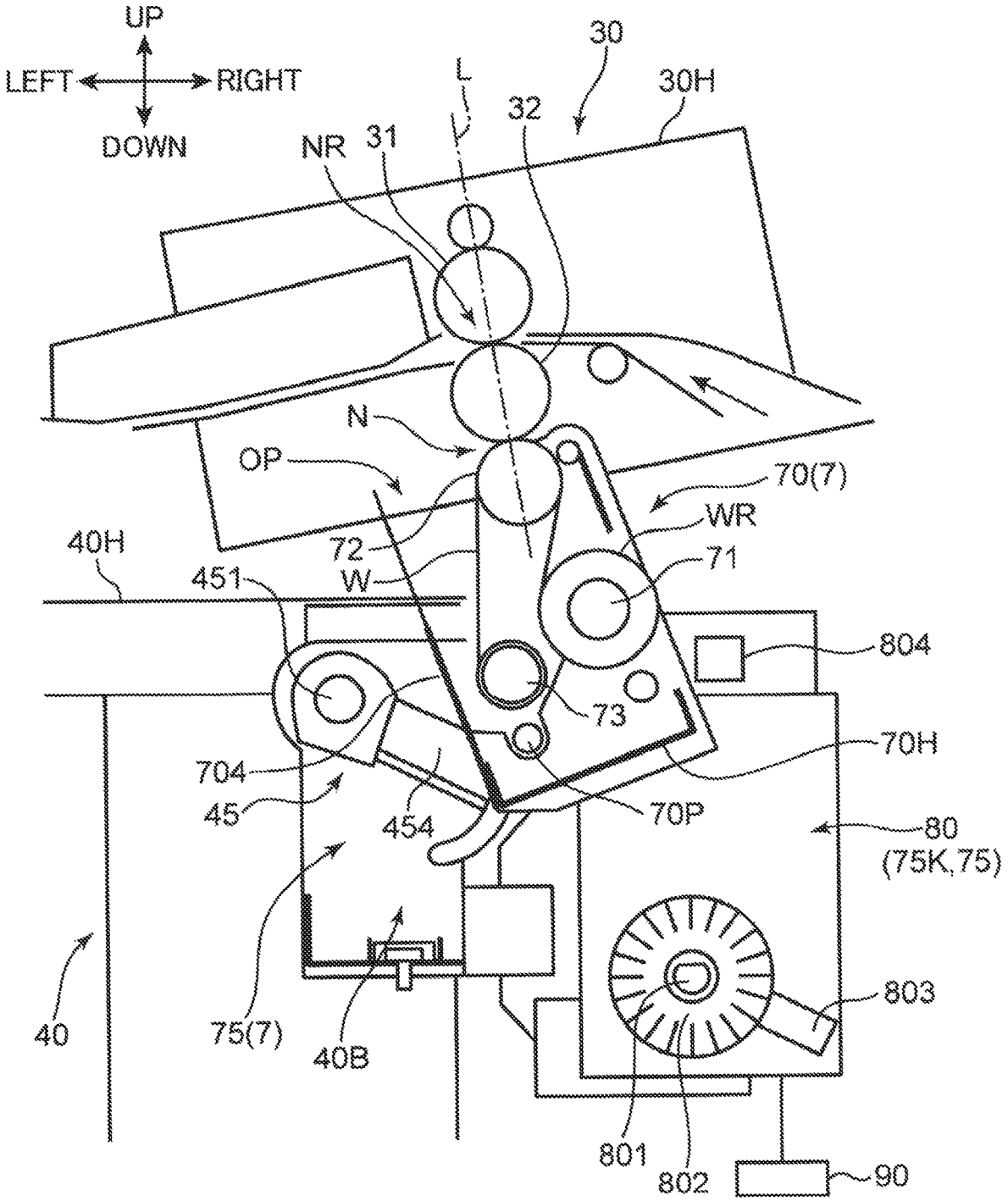
FIG. 2 is a cross-sectional view of a resist roller unit, a cleaning unit, and their surroundings included in the image forming apparatus, showing a state where the cleaning unit is located at a cleaning position.

FIG. 2 is a cross-sectional view of the resist roller unit 30, a cleaning unit 70, and their surroundings. The resist roller unit 30 conveys the sheet S toward the image forming unit 50 at timing matching timing of image forming by the image forming unit 50. The resist roller unit 30 has a resist housing 30H, and a pair of resist rollers consisting of a resist upper roller 31 (upper resist roller) and a resist lower roller 32 (conveyance roller or lower resist roller), the pair of resist rollers conveying the sheet. The resist housing 30H is mounted on the apparatus body 10, and rotatably supports the resist upper roller 31 and the resist lower roller 32. The sheet S is conveyed into a nip portion formed between the pair of resist rollers as indicated by an arrow in FIG. 2 in the resist housing 30H. The resist roller unit 30 has a roller drive unit (not shown) that drives the resist upper roller 31 and the resist lower roller 32 to rotate.

The resist upper roller 31 is a roller disposed on an upper side out of the pair of resist rollers. The resist upper roller 31 is formed of a metal roller. The resist lower roller 32 is a roller disposed on a lower side out of the pair of resist rollers. The resist lower roller 32 is formed of a rubber roller made of ethylene-propylene-diene rubber (EPDM) and the like, and has a tetrafluoroethylene-perfluoroalkoxyethylene copolymer resin (PFA) tube embedded in an outer peripheral surface of the resist lower roller 32. The resist lower roller 32 forms the nip portion between the resist lower roller 32 and the resist upper roller 31, the nip portion allowing the sheet S to travel therethrough, and conveys the sheet S toward the image forming unit 50 at timing matching timing of the image forming processing.

As shown in FIG. 2, a straight line L connecting the center of the resist upper roller 31 and the center of the resist lower roller 32 is inclined at an acute angle (for example, 10 degrees) with respect to a vertical direction. In other words, the resist lower roller 32 is disposed at the position displaced upstream in a conveyance direction of the sheet S with respect to the resist upper roller 31. The inclination of this straight line L results also because of the resist housing 30H itself being set inclined with its right side lifted upward.

When the above both-side printing is carried out, the sheet S having been subjected to single-side printing is reversed to have its front and back surfaces switched to each other, and is conveyed into the nip portion of the pair of resist rollers. As a result, the resist lower roller 32 comes in contact with a printed surface of the sheet S. At this time, undried ink adheres to a surface of the resist lower roller 32 in some cases. Such a case leads to a problem that ink adhering to the resist lower roller 32 is transferred to another incoming sheet S when it travels through the pair of resist rollers. Another concern is that the resist lower roller 32 disposed on the lower side out of the pair of resist rollers is a roller that allows foreign matter, such as paper dust, to adhere thereto easily.

[Cleaning Device]

Figure 12:
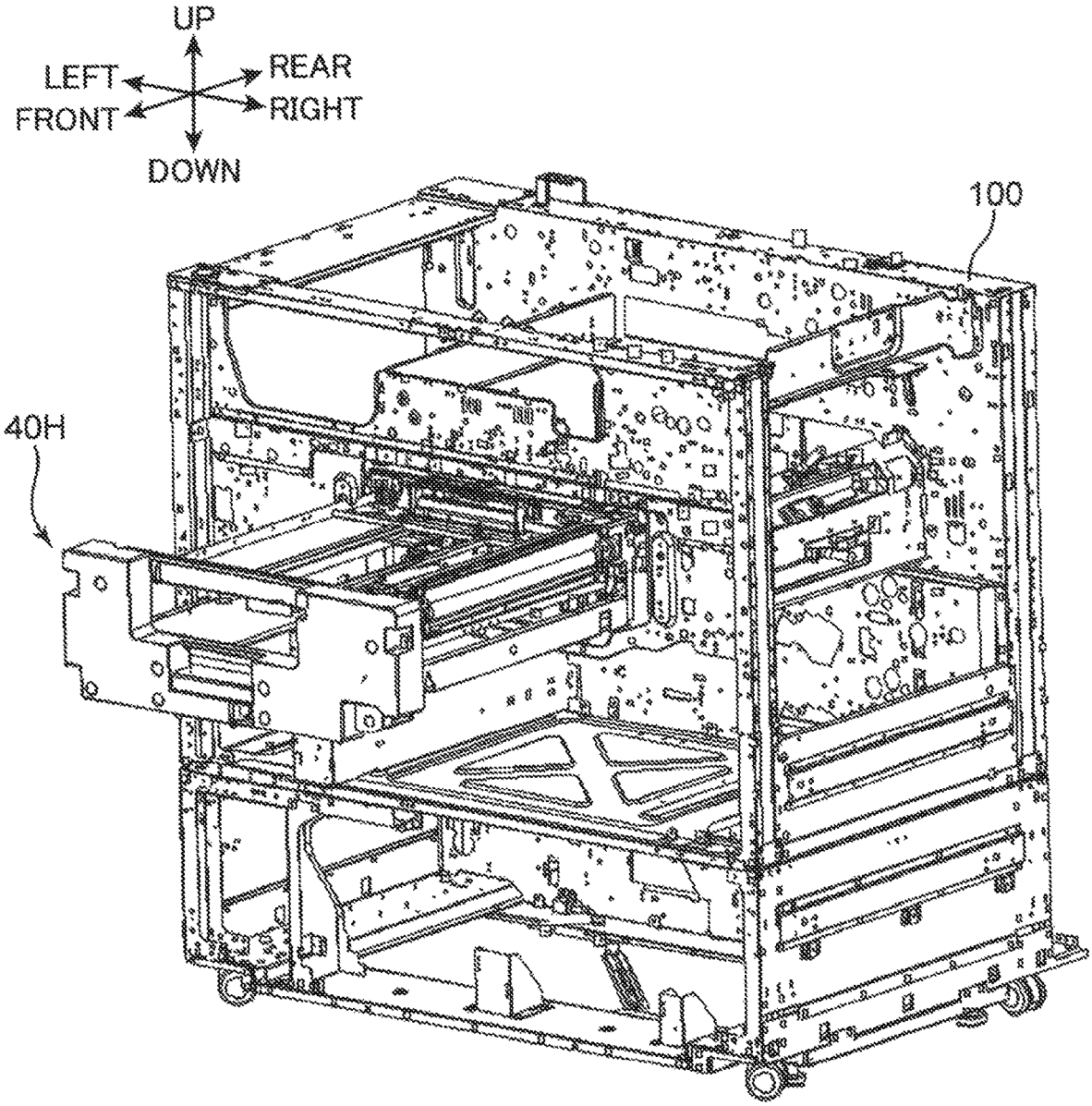
FIG. 12 is a perspective view showing a state where a conveyance unit frame is removed from a body frame of the image forming apparatus.

In view of the above circumstances, the image forming apparatus 1 according to the present embodiment is provided with a cleaning device 7. The cleaning device 7 can clean a surface of the resist lower roller 32. The cleaning device 7 has the cleaning unit 70 and a movement mechanism 75. The movement mechanism 75 can move the cleaning unit 70 at least between a cleaning position (FIG. 2) and a mounting and removing position (FIG. 12).

Figure 3:
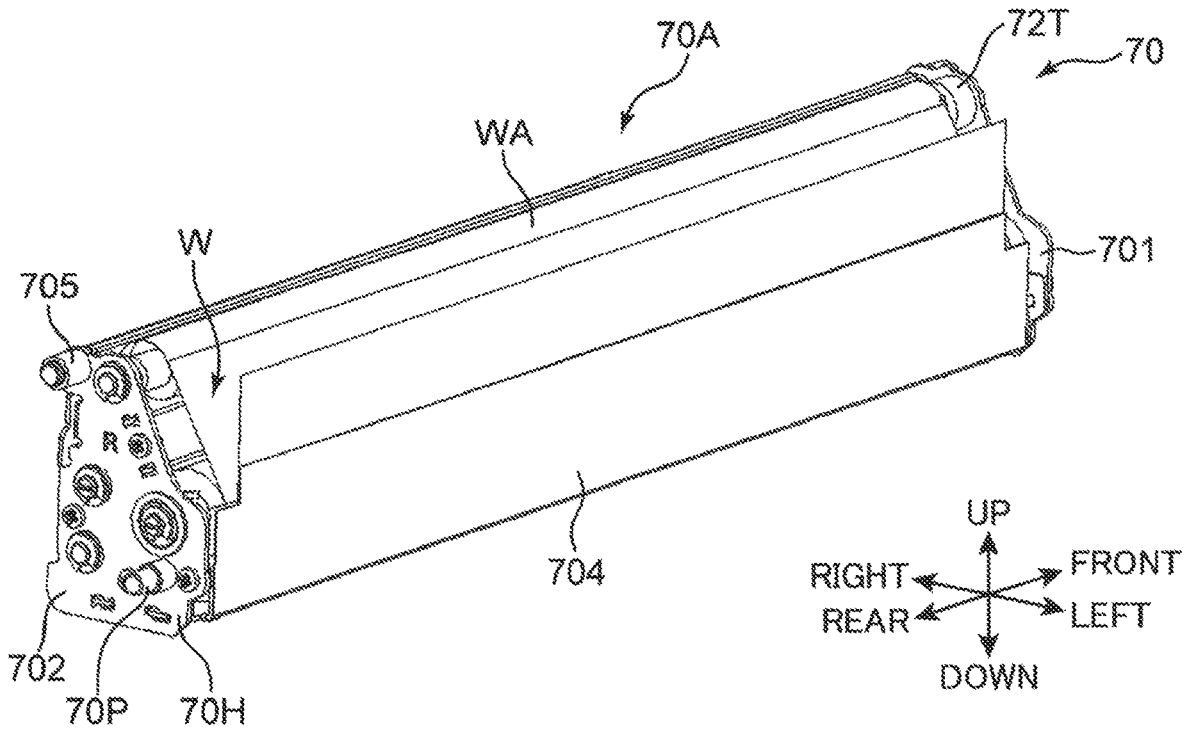
FIG. 3 is a perspective view of the cleaning unit.
Figure 4:
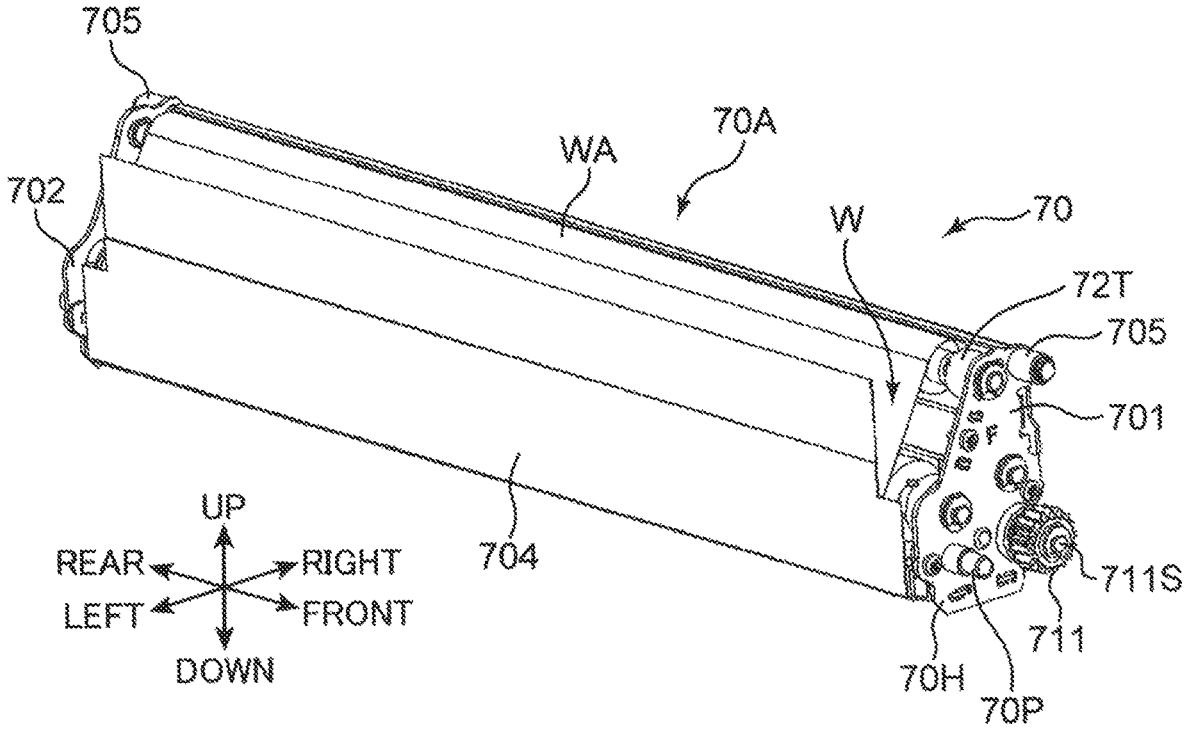
FIG. 4 is a perspective view of the cleaning unit that is seen in a direction different from a direction in which the cleaning unit of FIG. 3 is seen.
Figure 5:
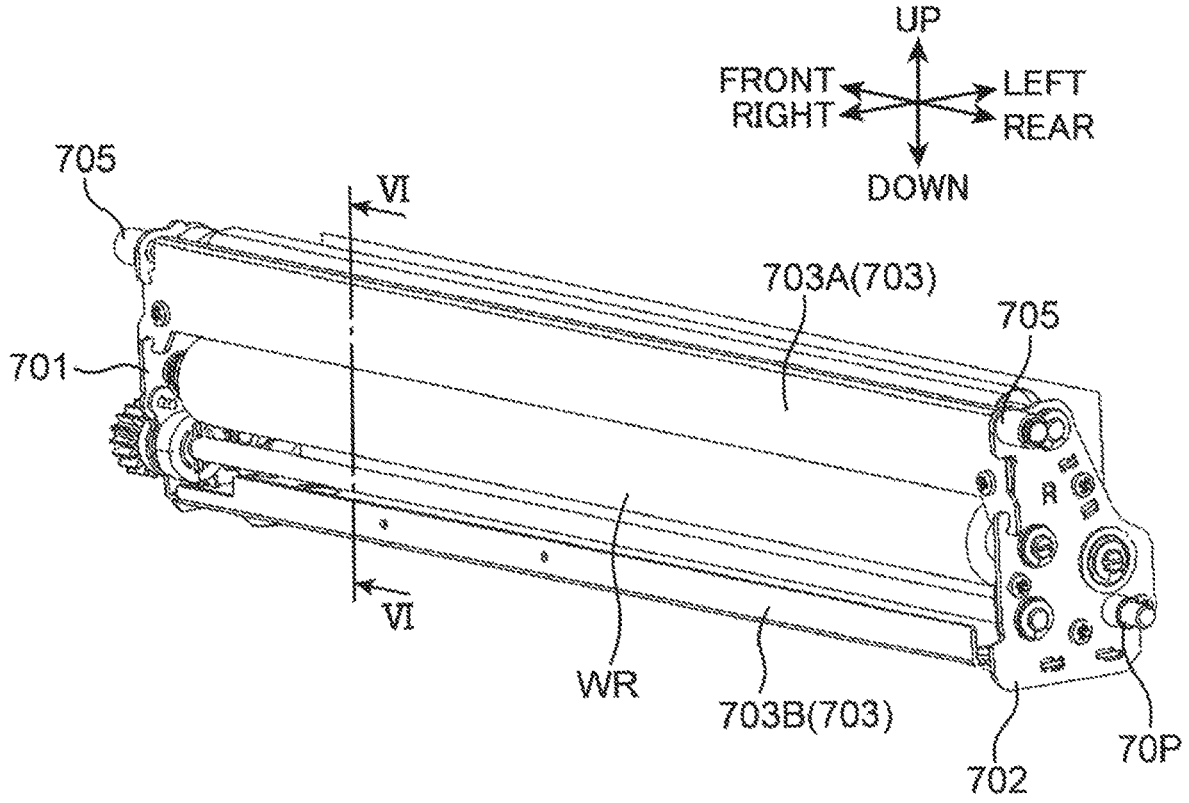
FIG. 5 is a perspective view of the cleaning unit that is seen in a direction different from directions in which the cleaning unit of FIGS. 3 and 4 is seen.
Figure 6A:
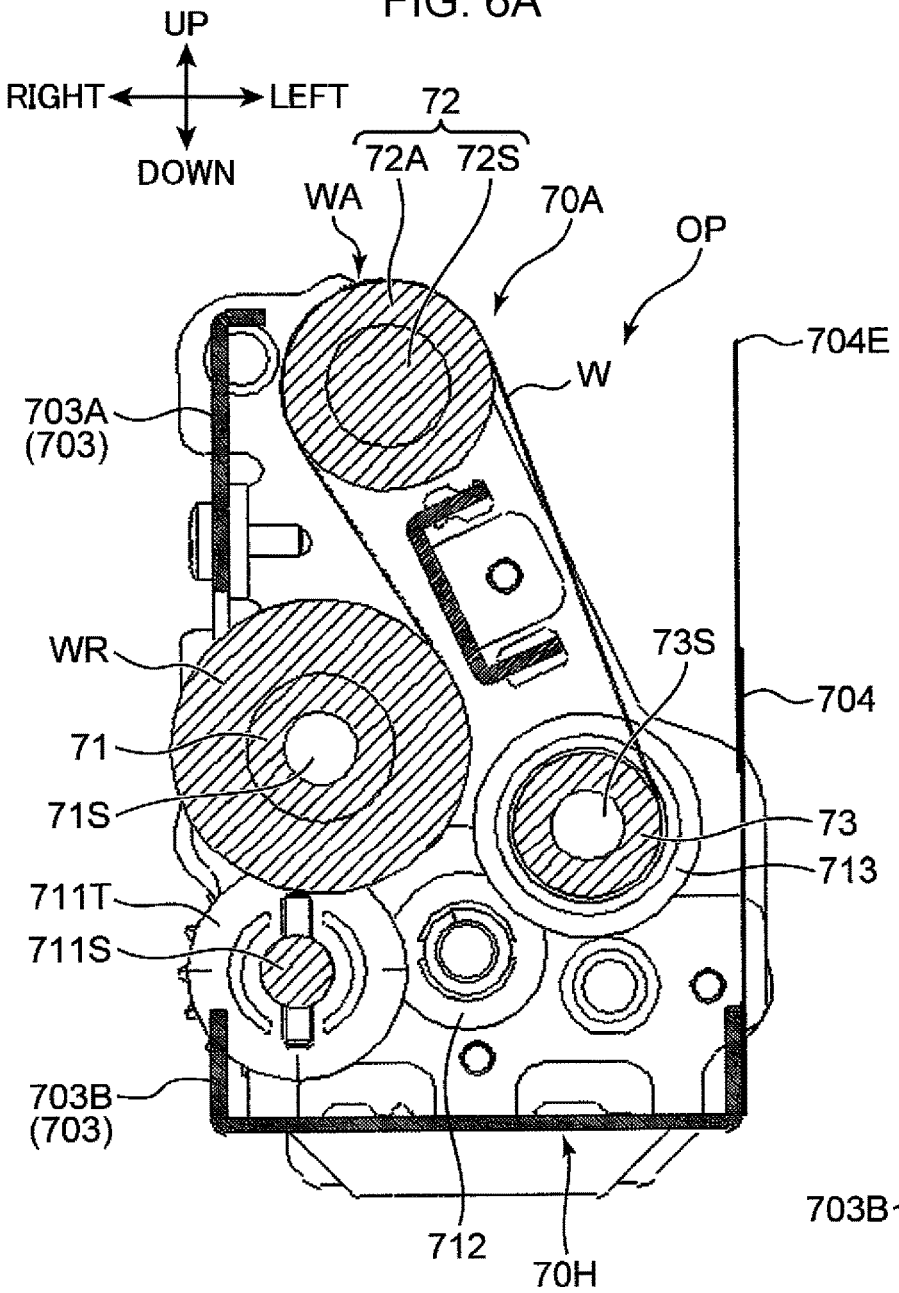
FIG. 6A is a cross-sectional view taken along line VI-VI in FIG. 5.
Figure 7:
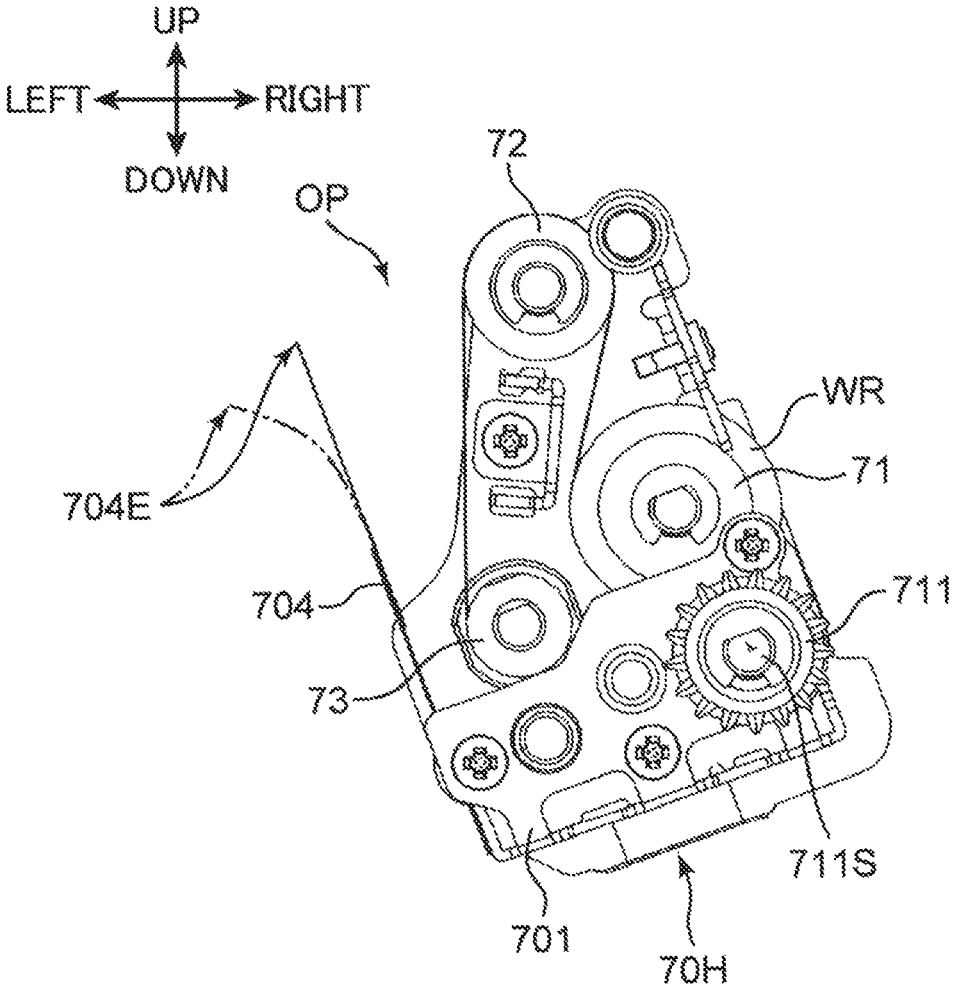
FIG. 7 is a front view of the cleaning unit from which some members making up the cleaning unit are omitted.
Figure 8:
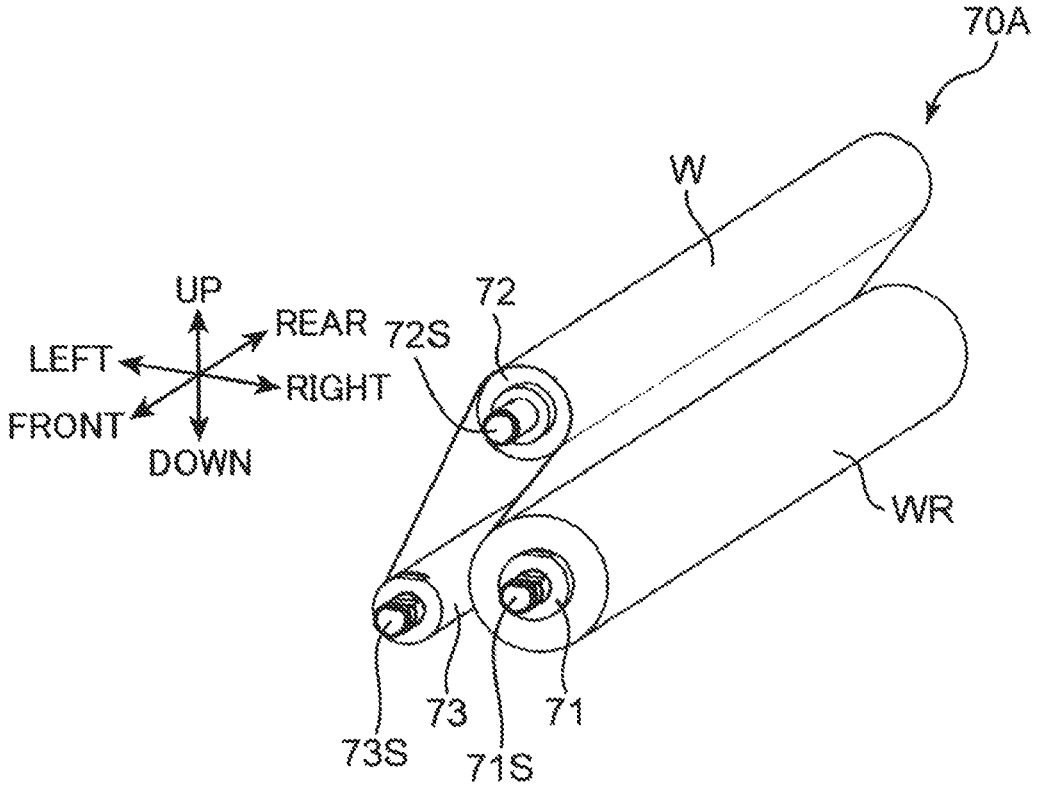
FIG. 8 is a perspective view showing an internal structure of the cleaning unit.

FIGS. 3 to 5 are perspective views of the cleaning unit 70 of the image forming apparatus 1 according to the present embodiment. FIG. 6A is a cross-sectional view taken along line VI-VI in FIG. 5. FIG. 7 is a front view of the cleaning unit 70 from which some members making up the cleaning unit 70 are omitted FIG. 8 is a perspective view showing an internal structure (cleaning part 70A) of the cleaning unit 70.

The cleaning unit 70 includes the cleaning part 70A and a cleaning housing (housing) 70H. The cleaning part 70A has a contact surface WA extending along an axial direction of the resist lower roller 32. The cleaning part 70A is disposed such that the contact surface WA comes in contact from below with the surface of the resist lower roller 32, and the contact surface WA wipes out the surface of the resist lower roller 32 to clean up the surface.

<Cleaning Housing>

The cleaning housing 70H supports the cleaning part 70A. The cleaning housing 70H has a front wall 701 and a rear wall 702, a connection wall 703, a pair of unit fulcrum pins 70P, a sheet member 704, and a pair of guide rollers 705. Each of the front wall 701, the rear wall 702, and the connection wall 703 of the cleaning housing 70H is made of a metal material (magnetic material).

The front wall 701 and the rear wall 702 (a pair of wall portions) are disposed so as to face each other in the front-rear direction (axial direction of the resist lower roller 32), and support the cleaning part 70A. The connection wall 703 connects the front wall 701 to the rear wall 702 along the front-rear direction. The connection wall 703 has a side wall 703A that makes up an upper right side surface of the cleaning housing 70H, and a bottom wall 703B that makes up a bottom of the cleaning housing 70H (FIGS. 5 and 6A).

The pair of unit fulcrum pins 70P project in the front-rear direction from an outer surface of the front wall 701 and the same of the rear wall 702, respectively. The unit fulcrum pins 70P are disposed on a left lower part of the front wall 701 and the same of the rear wall 702, respectively. Each unit fulcrum pin 70P has a circular cylindrical shape in two stages where an outer diameter of the unit fulcrum pin 70P decreases toward a distal end portion.

As shown in FIG. 6A, the sheet member 704 is a film-like member making up a left side surface of the cleaning housing 70H. The sheet member 704 is attached to the bottom wall 703B so as to extend upward. Specifically, the bottom wall 703B is a frame having a U-shaped section taken in the left-right direction of the frame. The bottom wall 703B thus has a U shape with a left-side plate portion rising from its bottom, and the sheet member 704 is pasted to this left-side plate portion so as to extend upward. The sheet member 704 prevents foreign matter, such as paper dust and ink pigment, collected by the cleaning unit 70 from scattering in the apparatus body 10. The sheet member 704, together with the front wall 701, the rear wall 702, and the connection wall 703 including the bottom wall 703B, jointly forms a box structure having an opening OP on its top surface.

Figure 6B:
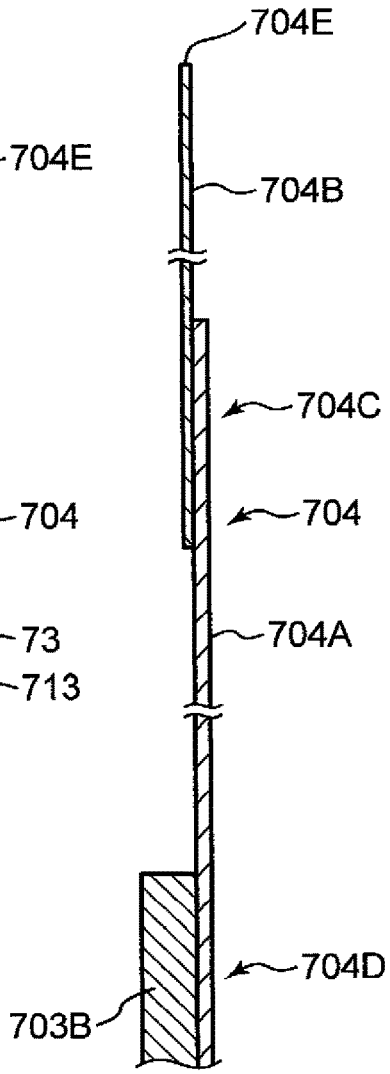
FIG. 6B is an enlarged cross-sectional view of a sheet member.

FIG. 6B is an enlarged cross-sectional view of the sheet member 704. The sheet member 704 is formed by joining together resin films with different thicknesses, i.e., a thick-walled film 704A (lower part) and a thin-walled film 704B (upper part). The thick-walled film 704A and the thin-walled film 704B may be provided as a film made of the same material, for example, a polyester film, such as Lumiler (Trade Name, available from Toray Industries, Inc). Respective thicknesses of both films 704A and 704B are chosen in consideration of constructing the sheet member 704 having the lower part with relatively higher rigidity (predetermined first rigidity) and the upper part with relatively lower rigidity (second rigidity lower than the first rigidity). When both films 704A and 704B are provided as the above polyester film, for example, a film of 0.25 mm in thickness (first thickness) may be used as the thick-walled film 704A and a film of 0.1 mm in thickness (second thickness) may be used as the thin-walled film 704B.

An upper part of the thick-walled film 704A and a lower part of the thin-walled film 704B are pasted together on a joining portion 704C to form a single sheet member 704. A lower part of the thick-walled film 704A serves as a fixing portion 704D that is pasted to the left-side plate portion of the bottom wall 703B. An upper edge 704E of the sheet member 704 is substantially at the same height as the height of an upper end of the side wall 703A. Between the upper edge 704E and the cleaning part 70A (pressing roller 72), the above opening OP is formed.

The pair of guide rollers 705 are supported above the unit fulcrum pins 70P on the front wall 701 and the rear wall 702, respectively, and each include an outer peripheral surface that can be rotated around a center axis parallel to the front-rear direction. The guide rollers 705 are disposed respectively on right upper parts of the front wall 701 and the rear wall 702. The pair of guide rollers 705 has a function of guiding the cleaning unit 70 when the cleaning unit 70 moves between the mounting and removing position and the cleaning position.

<Cleaning Part>

The cleaning part 70A has a web W, a web driven roller 71 (feed-out roller), a pressing roller 72, and a web drive roller 73 (take-up roller). Both ends of respective roller shafts of the web driven roller 71, the pressing roller 72, and the web drive roller 73 are supported rotatably on the front wall 701 and the rear wall 702 of the cleaning housing 70H, respectively. The bottom wall 703B is disposed under the cleaning part 70A.

The web W is a strip-shaped member forming the above contact surface WA, which comes in contact with the surface of the resist lower roller 32 to clean up the surface. The web W may be made of a fabric material, such as a nonwoven fabric. According to the present embodiment, as shown in FIGS. 6A and 8, the web W is rolled in advance into a web roll WR, which is fitted on the exterior of the web driven roller 71. A feed-out distal end of the web W is put over an outer peripheral surface of the pressing roller 72 and then is fixed to an outer peripheral surface of the web drive roller 73.

The pressing roller 72 is in contact with a back surface of the web W and presses a front surface of the web W against the resist lower roller 32. On a movement path of the web W, the pressing roller 72 lies at a midpoint between the web driven roller 71 and the web drive roller 73. The pressing roller 72 is an elastic roller constructed by fitting an elastic material 72A on a peripheral surface of a pressing roller shaft 72S (roller shaft). The pressing roller shaft 72S is a metal shaft, and may be provided as, for example, a shaft made of an iron solid material. The elastic material 72A may be provided as, for example, a sponge member made of an ethylene-propylene-diene rubber (EPDM) foam.

When the cleaning unit 70 is located at the above cleaning position (FIG. 2), the pressing roller 72 comes in contact with the resist lower roller 32, with the web W sandwiched between the pressing roller 72 and the resist lower roller 32, thus forming a nip portion N. At this time, a center of the pressing roller 72 is on the straight line L. The above contact surface WA is a contact portion where the web W comes in contact with the resist lower roller 32, the contact portion being a part of the nip portion N formed between the pressing roller 72 and the resist lower roller 32 so as to be on the straight line L, and is a strip-shaped portion extending in the front-rear direction. The sheet member 704 of the cleaning housing 70H is disposed so as to face the nip portion N across the opening OP. The opening OP is formed between the pressing roller 72 and the upper edge 704E (see FIG. 6A), and is open upward on the lower left of the nip portion N. In other words, the cleaning housing 70H has a box structure capable of receiving (collecting) foreign matter, such as paper dust and ink pigment, dropping from the vicinity of the nip portion N, through the opening OP.

The web driven roller 71 is a roller that can be driven to rotate around the axis of the driven roller shaft 71S (roller shaft). The web drive roller 73 is a roller that rotates around the axis of a drive roller shaft 73S (roller shaft), which is supplied with a rotational drive force from a drive system. The web drive roller 73 takes up the web W so as to cause a part of the web W that comes in contact with the resist lower roller 32 to shift. As a result of the web drive roller 73 taking up the web W, the web driven roller 71 feeds out the web W. The sheet member 704 of the cleaning housing 70H is disposed so as to face the web W supported in an extended manner between the pressing roller 72 and the web drive roller 73, across a space below the opening OP.

The pressing roller 72, the web driven roller 71, and the web drive roller 73 are fitted respectively with units that regulate the rotation of these rollers around their respective shafts. The pressing roller shaft 72S is fitted with a torque limiter 72T that limits the rotation of the pressing roller 72 when a torque larger than a predetermined value acts on the pressing roller 72. The driven roller shaft 71S of the web driven roller 71 is fitted with a brake spring 71T (break member shown in FIG. 10) that limits the rotation of the web driven roller 71 in its feed-out direction. The drive roller shaft 73S of the web drive roller 73 is fitted with a one-way clutch 73T (FIG. 11) that allows the web drive roller 73 to rotate only in its take-up direction.

[Drive System of Cleaning Unit]

The cleaning unit 70 has a unit input gear 711 (FIG. 4), an interlocking gear 711T, a transmission gear 712, and a drive roller gear 713 (FIG. 6A), which make up the above drive system. The unit input gear 711 is rotatably supported at a lower right end portion of the front wall 701. An input gear shaft 711S of the unit input gear 711 penetrates the front wall 701 and extends to the inside (back side) of the front wall 701. The interlocking gear 711T is fixed to the input gear shaft 711S, and rotates integrally with the unit input gear 711. The transmission gear 712 is rotatably supported on an inner side of the front wall 701, and engages with the interlocking gear 711T and with the drive roller gear 713. The drive roller gear 713 is a gear fixed to a front end portion of the drive roller shaft 73S of the web drive roller 73.

Figure 9:
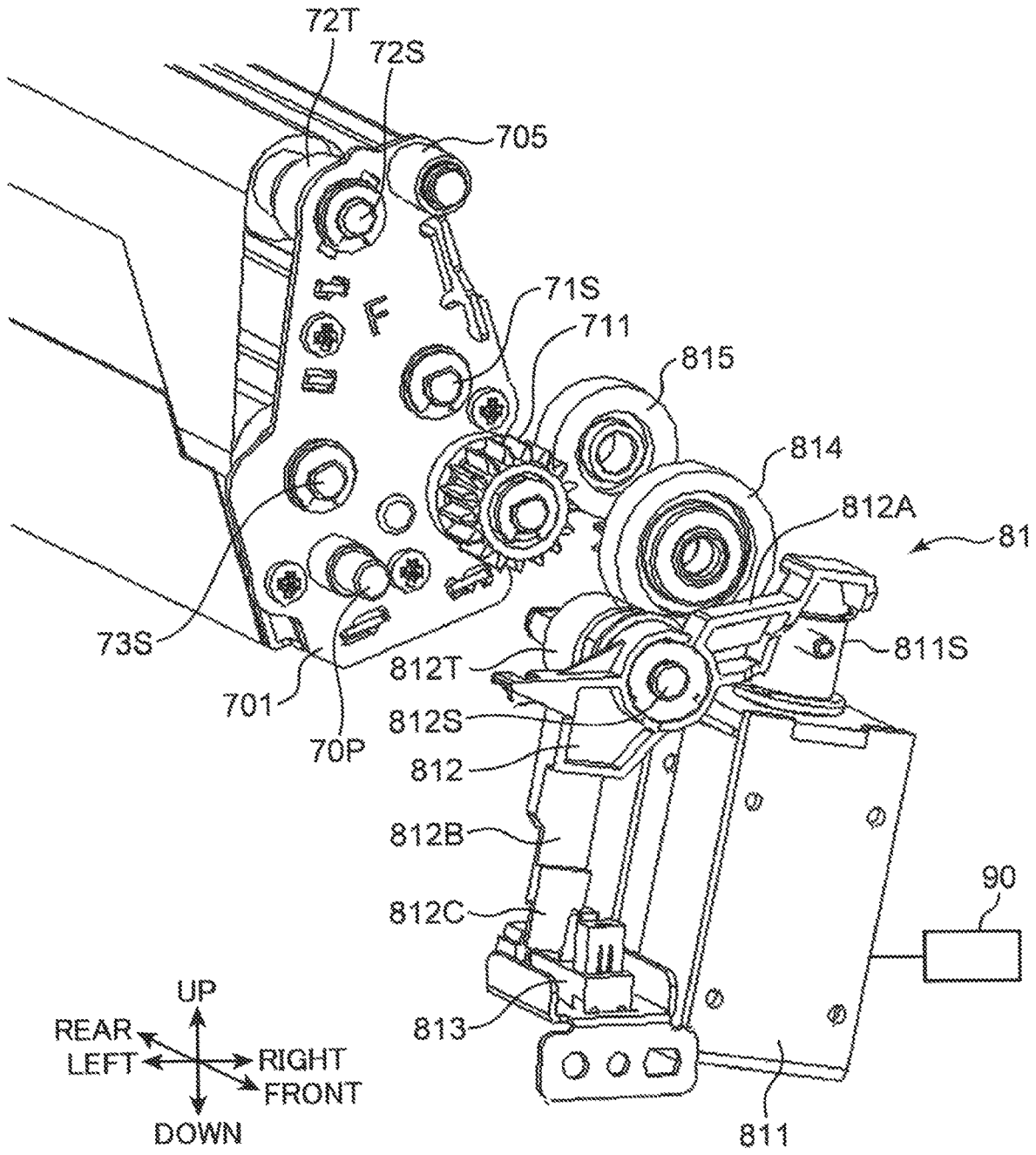
FIG. 9 is a perspective view of the cleaning unit and a web feed-out mechanism.
Figure 10:
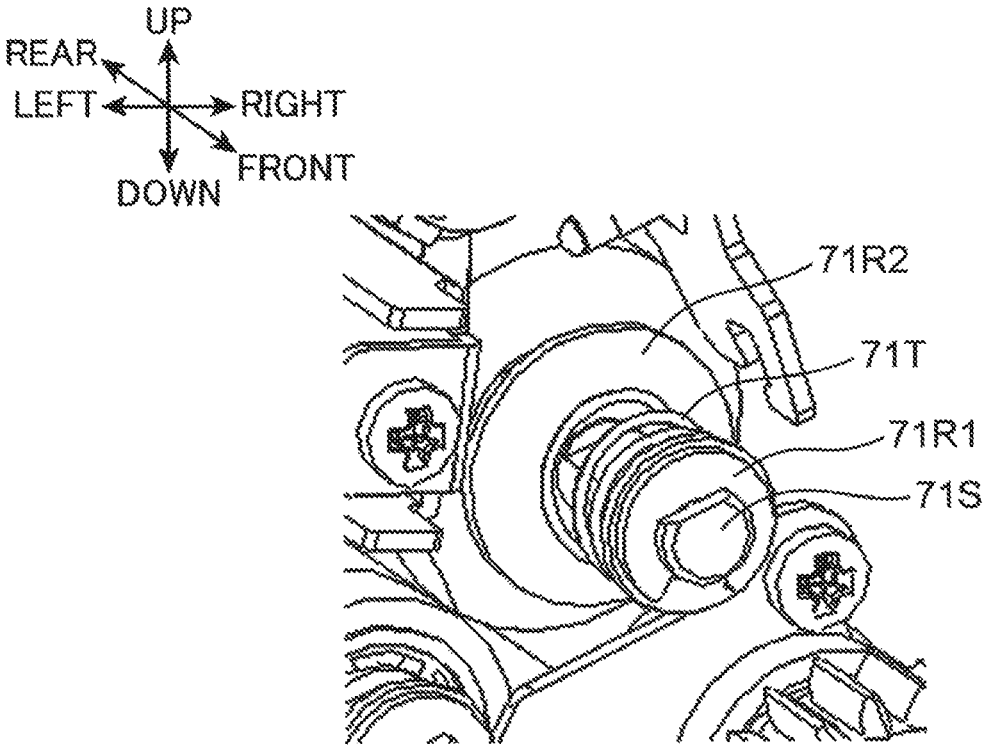
FIG. 10 is an enlarged perspective view of a part of the cleaning unit.
Figure 11:
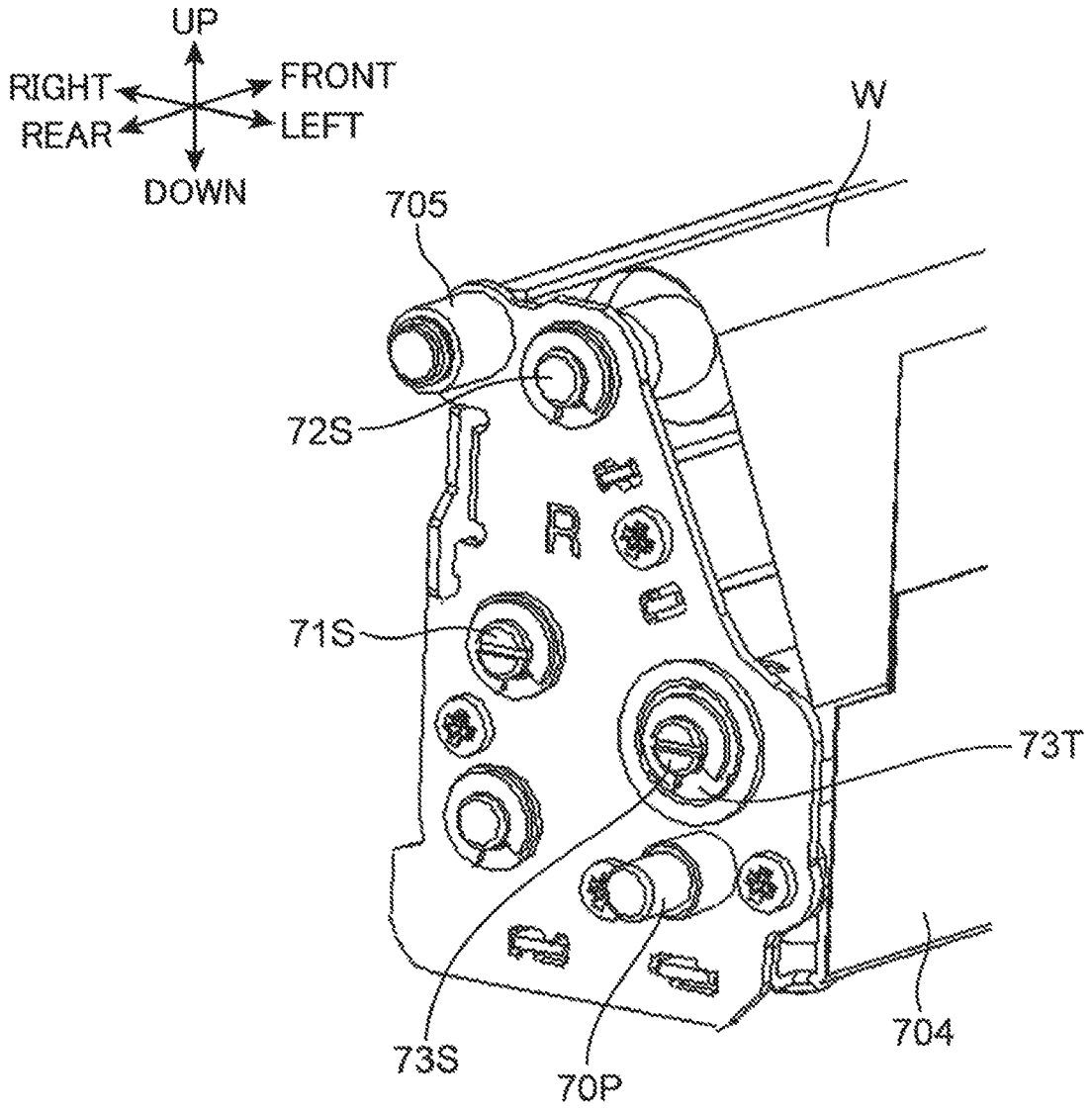
FIG. 11 is an enlarged perspective view of a part of the cleaning unit.

FIG. 9 is a perspective view of the cleaning unit 70 and a web feed-out mechanism 81. FIGS. 10 and 11 are enlarged perspective views of a part of the cleaning unit 70. The cleaning device 7 further includes the web feed-out mechanism 81 and a controller 90. The web feed-out mechanism 81 is mounted on the apparatus body 10 of the image forming apparatus 1. The web feed-out mechanism 81 has a function of giving the drive roller shaft 73S a rotational drive force to feed out the web W of the cleaning unit 70. The web feed-out mechanism 81 is coupled to the cleaning unit 70 when the cleaning unit 70 is located at the above cleaning position (FIG. 2). The web feed-out mechanism 81 has a solenoid 811, a rotary arm 812, a third detection sensor 813, a first transmission gear 814, and a second transmission gear 815. The controller 90 controls the operation of the solenoid 811.

Upon receiving an instruction signal from the controller 90, the solenoid 811 generates a drive force for moving the web W. The solenoid 811 includes an extendable and retractable shaft 811S. The extendable and retractable shaft 811S extends and retracts with respect to a body of the solenoid 811. The solenoid 811 is supported by a sheet-metal-made drive frame (not shown) which is disposed inside the apparatus body 10.

The rotary arm 812 is rotatably supported on a shaft 812S (FIG. 9) attached to the drive frame in the apparatus body 10. The shaft 812S is supported by the drive frame such that the shaft 812S is rotatable about a rotation center axis extending in the front-rear direction. The rotary arm 812 has a first arm portion 812A and a second arm portion 812B. The first arm portion 812A extends rightward from the rotation center axis of the rotary arm 812. A distal end portion of the first arm portion 812A is connected to the extendable and retractable shaft 811S. The second arm portion 812B extends toward a side opposite to the first arm portion 812A and downward from the rotation center axis of the rotary arm 812. On a distal end portion (lower end portion) of the second arm portion 812B, a detection piece 812C is disposed. A gear portion 812T which can rotate integrally with the shaft 812S is mounted on a rear end portion of the shaft 812S. Further, the web feed-out mechanism 81 has a first one-way clutch (not shown) and a second one-way clutch (not shown). The first one-way clutch is fixedly mounted in the rotary arm 812 and is fitted on the shaft 812S. The second one-way clutch is fixed to the drive frame in a state where the second one-way clutch is disposed adjacently to the first one-way clutch, and is fitted on the shaft 812S.

The third detection sensor 813 is fixed to a left end portion of a body of the solenoid 811. The third detection sensor 813 is a photo-interrupter (PI) sensor that detects a movement (rotation) of the detection piece 812C. The controller 90 can detect an amount of feed-out of the web roll WR that corresponds to the number of times of detection of movement of the detection piece 812C, the number of times being output from the third detection sensor 813. When the above number of times of detection reaches a number of times preset as a threshold value, the controller 90 causes a display unit (not shown) of the image forming apparatus 1 to display a message that recommends replacement of the cleaning unit 70.

The first transmission gear 814 is rotatably supported by the apparatus body 10 and engages with the gear portion 812T. The first transmission gear 814 is formed of a two-stage gear. Similarly, the second transmission gear 815 is rotatably supported by the apparatus body 10, engages with a rear gear portion of two gears making up the two-stage gear, i.e., first transmission gear 814, and engages with the above unit input gear 711.

FIG. 9 shows a state where the extendable and retractable shaft 811S comes (retracts) into a body of the solenoid 811. In the state shown in FIG. 9, when the controller 90 inputs an instruction signal to the solenoid 811, the extendable and retractable shaft 811S comes (extends) out of the body of the solenoid 811. As a result, the rotary arm 812 rotates around the shaft 812S in a counterclockwise direction in FIG. 9. At this stage of the operation, the rotary arm 812 is rotated relative to the shaft 812S by an action of the above-described first one-way clutch so that there is no possibility that the shaft 812S rotates. In a case of feeding out the web W by a predetermined amount, on the other hand, the controller 90 inputs an instruction signal to the solenoid 811, thus causing the extendable and retractable shaft 811S to retract into the body of the solenoid 811. As a result, the rotary arm 812 rotates around the shaft 812S in a clockwise direction in FIG. 9. At this stage of the operation, the shaft 812S rotates integrally with the rotary arm 812 by a predetermined angle by an action of the above-described first one-way clutch. As a result, a rotational drive force is transmitted from the gear portion 812T, which is fixed to the shaft 812S, to the unit input gear 711 of the cleaning unit 70, via the first transmission gear 814 and the second transmission gear 815.

The rotational drive force input to the unit input gear 711 is transmitted sequentially to the interlocking gear 711T, the transmission gear 712, and the drive roller gear 713, thus causing the web drive roller 73 to rotate by a preset angle of rotation. Hence the web W is taken up by the web drive roller 73 to move. This results in a shift in a part of the web W that is in contact with the resist lower roller 32. Specifically, as a result of the web W being taken up, the contact surface WA having been in contact with the resist lower roller 32 moves downstream in a take-up direction, and another part of the web W comes in contact with the resist lower roller 32 to form the contact surface WA anew. The third detection sensor 813 detects the movement of the detection piece 812C every time the rotary arm 812 makes one stroke of rotation. Through this process, the unit input gear 711 having rotated to move the web W is detected.

When the web W moves, the controller 90 inputs an instruction signal to the solenoid 811, thereby causing the extendable and retractable shaft 811S to extend again out of the body of the solenoid 811. At this stage of the operation, it is possible to prevent the shaft 812S from rotating in a reverse direction by an action of the above-described second one-way clutch. Further, as shown in FIG. 11, the one-way clutch 73T fitted to the drive roller shaft 73S of the web drive roller 73 works to prevent the web drive roller 73 from rotating in the reverse direction. Thus, every time the controller 90 causes the extendable and retractable shaft 811S to extend and retract, the web W moves toward the web drive roller 73 by a predetermined amount. In this manner, according to the present embodiment, the web W can be fed out from the web roll WR by using a slight stroke of extension and retraction of the extendable and retractable shaft 811S of the solenoid 811.

As shown in FIG. 9, the torque limiter 72T is fitted to a front end side of the pressing roller shaft 72S of the pressing roller 72. In the process of feeding out and taking up the web W by the web driven roller 71 and the web drive roller 73, the torque limiter 72T permits the rotation of the pressing roller 72 around the pressing roller shaft 72S when an ordinary torque is created at the pressing roller 72. When a torque larger than the ordinary torque is created at the pressing roller 72, on the other hand, the torque limiter 72T prohibits (restrict) the rotation of the pressing roller 72 around the pressing roller shaft 72S.

As shown in FIG. 10, the above brake spring 71T is attached to the driven roller shaft 71S of the web driven roller 71. The brake spring 71T in its compressed form is interposed between an E-ring 71R1 and a flange 71R2. From FIG. 10, the front wall 701 shown in FIG. 9 is omitted. The flange 71R2 is a ring-shaped flange fixed to the pressing roller shaft 72S of the pressing roller 72. A rear end portion of the brake spring 71T is in contact with the flange 71R2. A front end portion of the brake spring 71T is in contact with a back surface of the front wall 701. Because of this configuration, a compressive force of the brake spring 71T is applied to the pressing roller 72 via the flange 71R2, thus preventing the pressing roller 72 from rotating unnecessarily. As a result, despite the controller 90 not exerting control over the solenoid 811, the web W being fed out from the pressing roller 72 is prevented.

[Mechanism that Changes Position of Cleaning Unit]

The movement mechanism 75 (FIG. 2) is a mechanism that allows the cleaning unit 70 to be moved among the cleaning position (FIG. 2), the mounting and removing position (FIG. 19) below the cleaning position, and the separation position (FIG. 20) located between the cleaning position and the mounting and removing position. At the cleaning position, the movement mechanism 75 allows the pressing roller 72 of the cleaning part 70A to come in contact with the resist lower roller 32 with the web W sandwiched between the pressing roller 72 and the resist lower roller 32. At the mounting and removing position, the movement mechanism 75 allows the cleaning part 70A to be disposed below the resist lower roller 32 in a separated manner and allows the cleaning unit 70 to be mounted and removed on and from the apparatus body 10. At the separation position, the cleaning part 70A is disposed below the resist lower roller 32 in a separated manner as the cleaning unit 70 is disconnected from the above web feed-out mechanism 81.

The movement mechanism 75 functions as a separation and contact mechanism that moves the cleaning unit 70 to shift a position of the pressing roller 72 relative to the resist lower roller 32, thereby causing the web W to separate and come in contact from and with the resist lower roller 32. The movement mechanism 75 moves the cleaning unit 70 to the cleaning position, and thus bringing the web W into contact with the resist lower roller 32 due to pressing of the pressing roller 72. Further, the movement mechanism 75 moves the cleaning unit 70 to the separation position, and thus disposing the pressing roller 72 below the resist lower roller 32 in a separated manner. Accordingly, the web W is separated from the resist lower roller 32.

Figure 13:
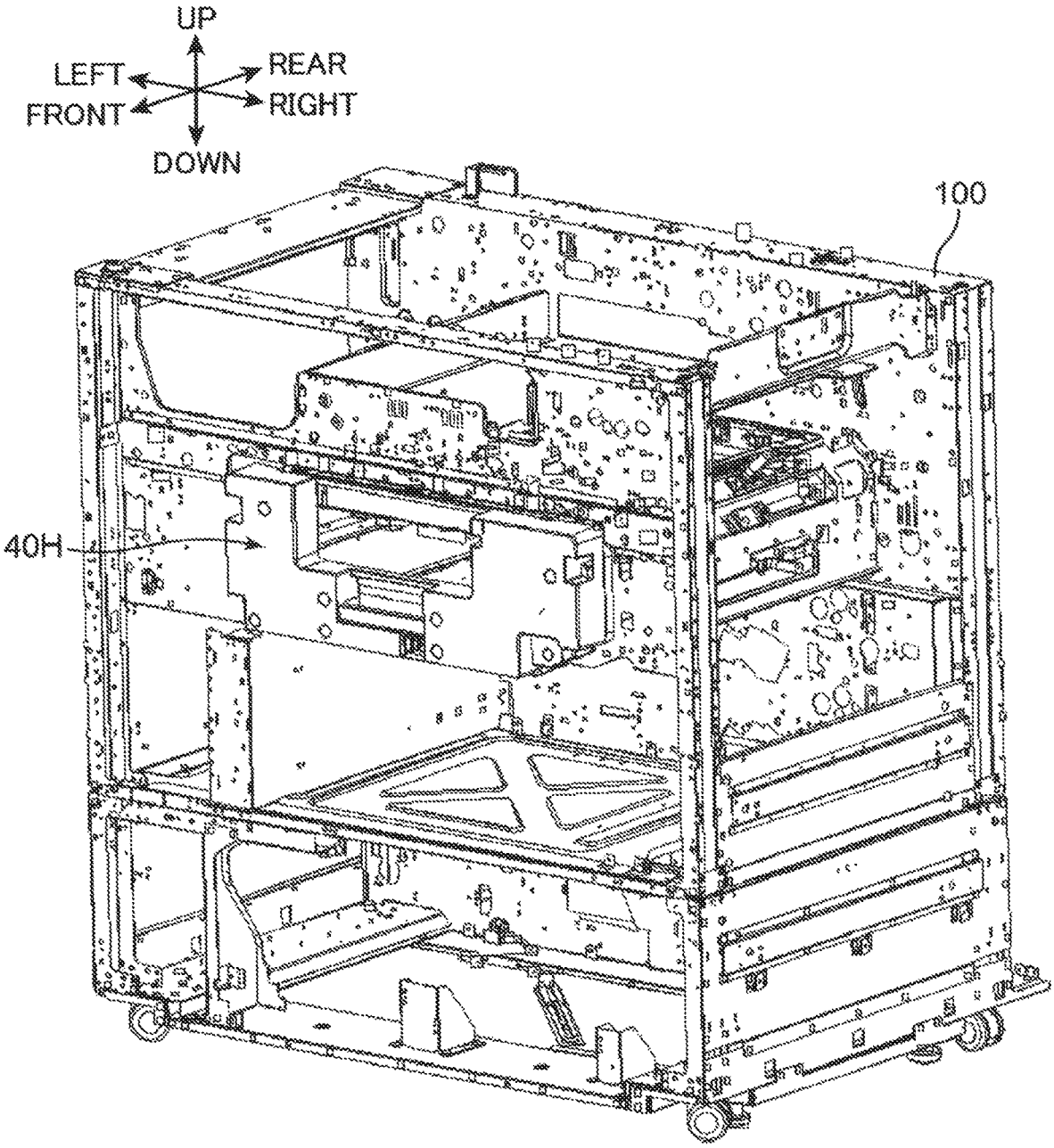
FIG. 13 is a perspective view showing a state where the conveyance unit frame is mounted in the body frame.
Figure 14:
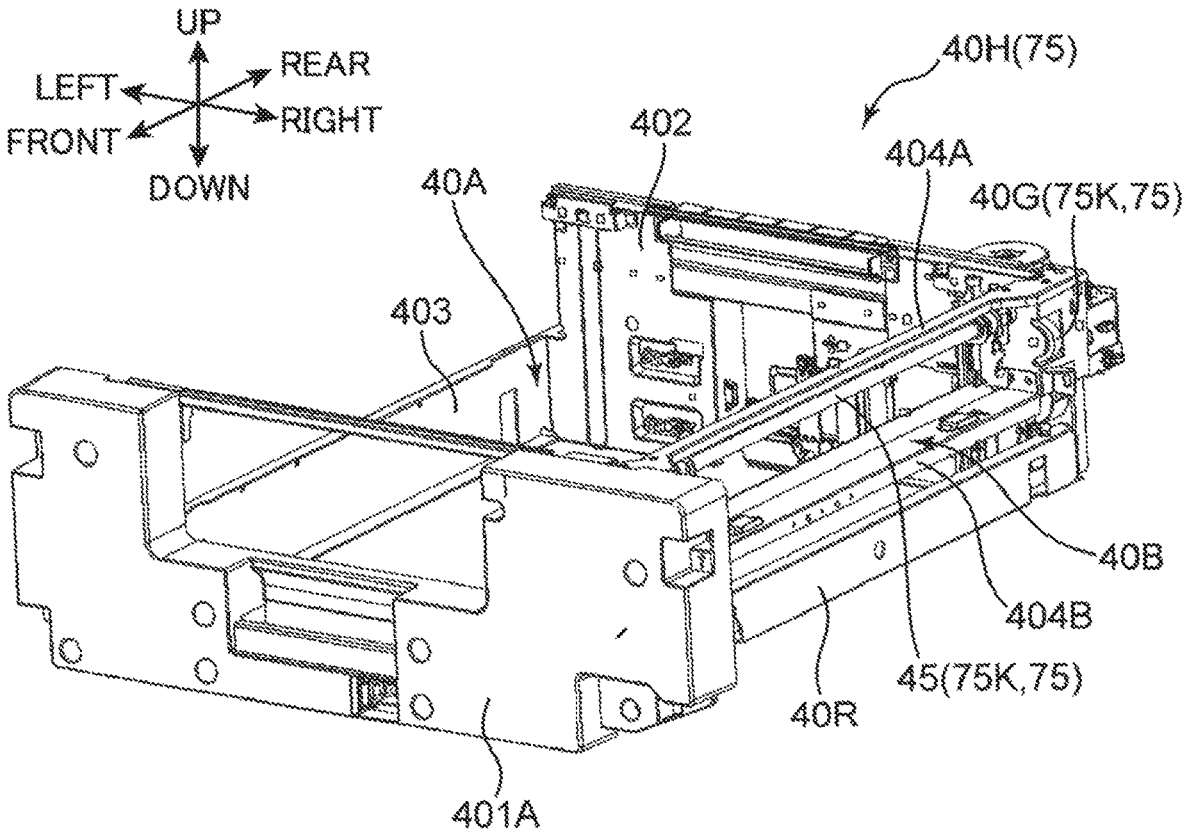
FIG. 14 is a perspective view of the conveyance unit frame.
Figure 15:
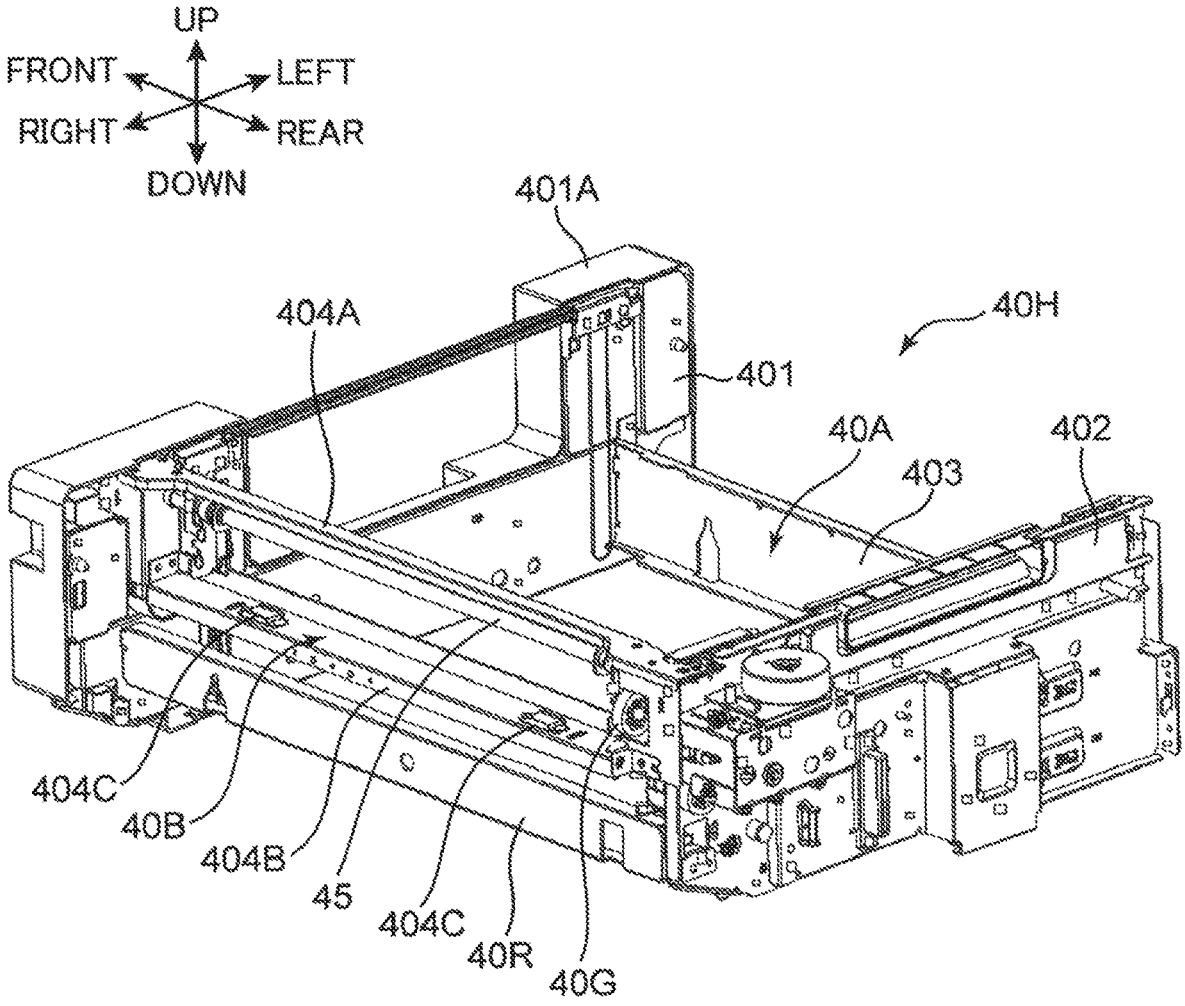
FIG. 15 is a perspective view of the conveyance unit frame.

FIG. 12 is a perspective view showing a state where a conveyance unit frame 40H is removed from a body frame 100 making up the apparatus body 10 of the image forming apparatus 1. The conveyance unit frame 40H is pulled out forward from the body frame 100. Pulling out the conveyance unit frame 40H allows replacement of the cleaning unit 70. FIG. 13 is a perspective view showing a state where the conveyance unit frame 40H is mounted in the body frame 100. FIGS. 14 and 15 are perspective views of the conveyance unit frame 40H.

The belt conveyance unit 40 shown in FIG. 1 includes the conveyance unit frame 40H. The conveyance unit frame 40H integrally supports the conveyance belt 41, the first support roller 421, the second support roller 422, the third support roller 423, the pair of fourth support rollers 424, and the suction unit 43. The conveyance unit frame 40H can be mounted in the body frame 100 of the apparatus body 10 in a first direction (rearward direction) parallel to the front-rear direction (the axial direction of the resist lower roller 32), and can be removed from the body frame 100 along a second direction (frontward direction) opposite to the first direction.

As shown in FIGS. 14 and 15, the conveyance unit frame 40H includes a front frame 401, a rear frame 402, a left frame 403, a first right frame 404A, a second right frame 404B, and a pair of front and rear magnets 404C, and a pair of left and right rail portions 40R.

The front frame 401 is a frame disposed on a front surface portion of the conveyance unit frame 40H. The front frame 401 is fitted with a front cover 401A. The front cover 401A forms a part of the front surface portion of the apparatus body 10. The rear frame 402 is a frame disposed on a rear surface portion of the conveyance unit frame 40H, and is disposed so as to face the front frame 401 in the front-rear direction. The left frame 403 is disposed on a left end portion of the conveyance unit frame 40H, and connects the front frame 401 and the rear frame 402 to each other along the front-rear direction. The first right frame 404A and the second right frame 404B are disposed on the right end portion of the conveyance unit frame 40H, and connect the front frame 401 and the rear frame 402 to each other along the front-rear direction. The first right frame 404A is disposed along an upper surface portion of the conveyance unit frame 40H, and the second right frame 404B is disposed below the first right frame 404A. Both end portions of the first right frame 404A and both end portions of the second right frame 404B in the front-rear direction are respectively connected to each other along a vertical direction by a pair of side plates (not shown) which is disposed inside the front frame 401 and the rear frame 402. As a result, a rectangular frame structure is formed by the first right frame 404A, the second right frame 404B, and the above-described pair of side plates.

The left and right rail portions 40R which form a pair are rail portions for allowing the conveyance unit frame 40H to move in a slidable manner in the front-rear direction with respect to the body frame 100. In FIGS. 14 and 15, out of the left and right rail portions 40R, only the right rail portion 40R is shown. However, the same rail portion 40R is disposed also on the left end portion of the conveyance unit frame 40H. The magnets 404C which form a pair are magnets disposed on an upper surface portion of the second right frame 404B at intervals in the front-rear direction. The pair of magnets 404C has a function of holding the cleaning unit 70.

On the conveyance unit frame 40H, a conveyance unit mounting portion 40A is formed on the left with respect to the first right frame 404A and the second right frame 404B. In the conveyance unit mounting portion 40A, components making up the belt conveyance unit 40, that is, the conveyance belt 41, the first support roller 421, the second support roller 422, the third support roller 423, the pair of fourth support rollers 424, the suction unit 43, and the like are disposed. In a space between the first right frame 404A and the second right frame 404B, on the other hand, a cleaning unit mounting portion 40B (unit housing portion) is disposed. The cleaning unit mounting portion 40B allows the above-described cleaning unit 70 disposed at the mounting and removing position to be mounted on the cleaning unit mounting portion 40B, and houses the cleaning unit 70. Because of the conveyance unit frame 40H configured in this manner, the cleaning unit 70, together with the belt conveyance unit 40 mounted integrally to the conveyance unit frame 40H, can be mounted and removed in and from the body frame 100 (apparatus body 10).

Figure 16:
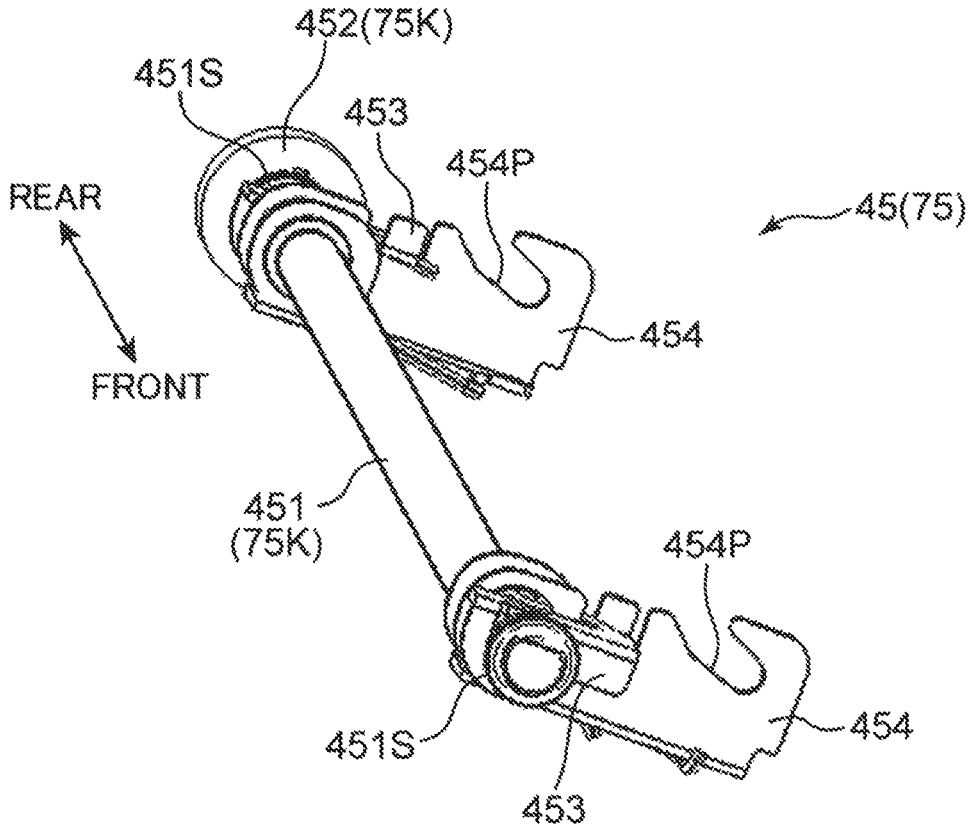
FIG. 16 is a perspective view of a cleaning unit rotating unit of the conveyance unit frame.

The conveyance unit frame 40H further has a cleaning unit rotating unit 45 and a rotation input gear 40G. FIG. 16 is a perspective view of the cleaning unit rotating unit 45. The cleaning unit rotating unit 45 is supported by the pair of side plates just below the first right frame 404A. The cleaning unit rotating unit 45 includes a rotary shaft 451, a pair of front and rear bearings 4515, a rotary gear 452, a pair of front and rear lever support portions 453, and a pair of front and rear rotary levers 454.

The rotary shaft 451 is rotatably supported by the pair of side plates by way of the pair of front and rear bearings 4515. The rotary shaft 451 extends along the front-rear direction (the axial direction of the resist lower roller 32) and serves as a center of rotation of the pair of rotary levers 454. The rotary gear 452 is a gear fixed to a rear end portion of the rotary shaft 451, and engages with the rotation input gear 40G.

The pair of front and rear rotary levers 454 are disposed on the cleaning unit mounting portion 40B, and support the cleaning housing 70H of the cleaning unit 70 so as to sandwich the cleaning housing 70H from both sides in the front-rear direction. Pin receiving portions 454P are formed on the pair of front and rear rotary levers 454 respectively. The pin receiving portions 454P receive the unit fulcrum pins 70P (FIGS. 3 and 4) of the cleaning unit 70 along a direction orthogonal to the front-rear direction, and rotatably support the unit fulcrum pins 70P. The pair of front and rear lever support portions 453 are fixed to the rotary shaft 451 such that the front and rear lever support portions 453 can hold the pair of rotary levers 454, respectively.

The cleaning device 7 further includes a rotation drive unit 75K. In a state where the pair of unit fulcrum pins 70P are pivotally supported on the pair of pin receiving portions 454P, the rotation drive unit 75K causes the pair of rotary levers 454 to rotate around a center axis of the rotary shaft 451 so that the cleaning unit 70 moves between the cleaning position and the mounting and removing position via the separation position. Further, the rotation drive unit 75K rotates the pair of rotary levers 454 while allowing the pair of unit fulcrum pins 70P to rotate relative to the pair of pin receiving portions 454P so that the cleaning unit 70 maintains its orientation where the cleaning part 70A (web W) faces upward.

Figure 19:
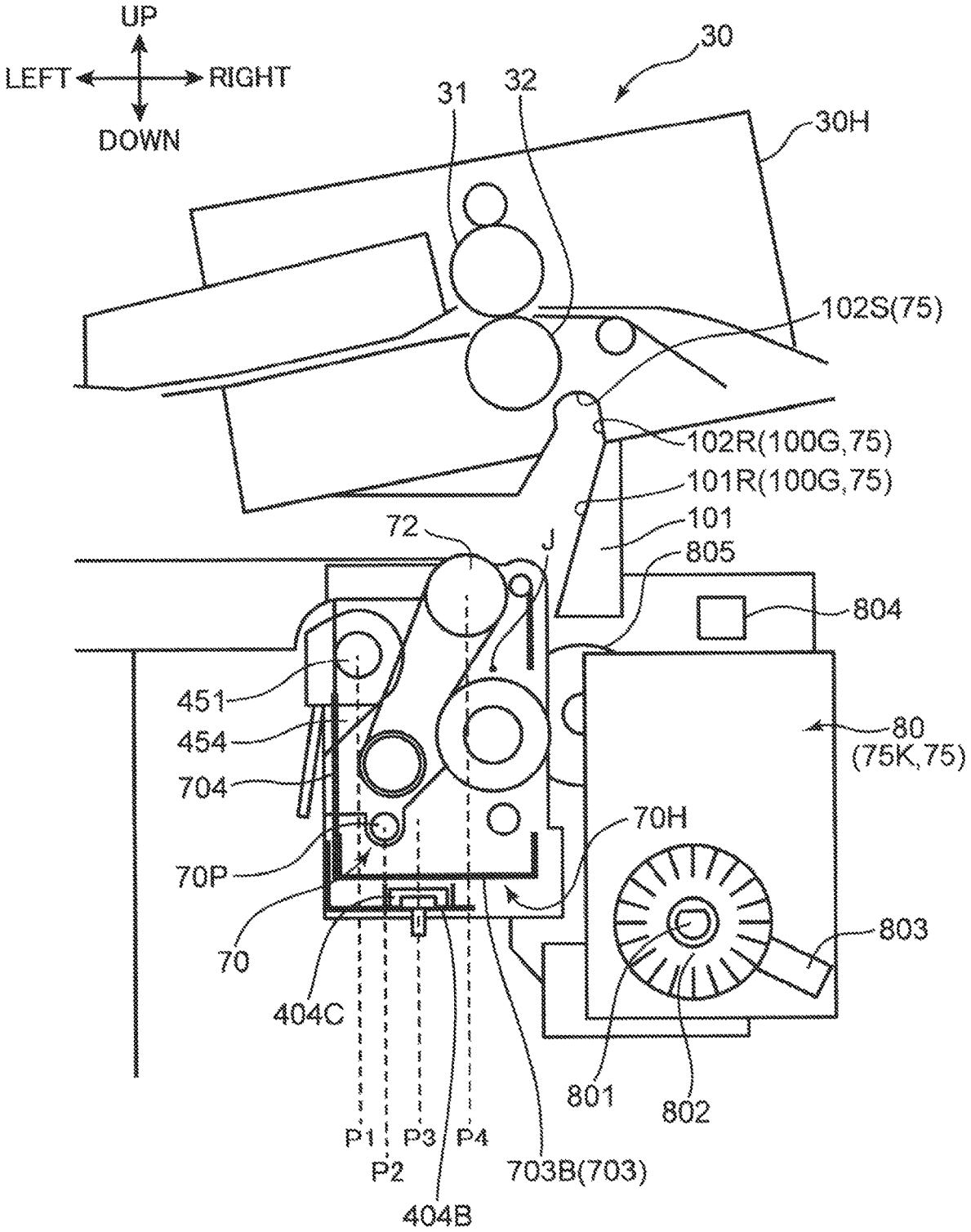
FIG. 19 is a cross-sectional view of a pair of resist rollers, the cleaning unit, and their surroundings, showing a state where the cleaning unit is located at a mounting and removing position.

The rotation drive unit 75K has a unit driving unit 80 (FIG. 2) in addition to the above-described cleaning unit rotating unit 45. The unit driving unit 80 generates a drive force for rotating the rotary shaft 451 of the cleaning unit rotating unit 45 about the center axis of the rotary shaft 451. As shown in FIG. 2, the unit driving unit 80 has a motor (not shown) including a drive motor output shaft 801, a pulse plate 802, a first detection sensor 803, a second detection sensor 804, and a unit drive output gear 805 (which is shown in FIG. 19).

The pulse plate 802 is fixed to the drive motor output shaft 801, and rotates integrally with the drive motor output shaft 801. The first detection sensor 803 detects a rotation amount of the pulse plate 802. Specifically, the first detection sensor 803 includes a light emitting part for emitting detection light, and a light receiving part for receiving the detection light. The pulse plate 802 has a plurality of slits that are open at intervals along the direction of rotation of the pulse plate 802. As the pulse plate 802 rotates, the detection light blocked by the pulse plate 802 leaks through the slits to create a waveform of the detection light, and the light receiving part outputs a signal corresponding to the waveform, to the controller 90. Through this process, an amount of rotation of the drive motor output shaft 801 (the pair of rotary levers 454) is detected.

The second detection sensor 804 is formed of a publicly known PI sensor, and detects that the cleaning unit 70 is disposed at the cleaning position shown in FIG. 2. In the present embodiment, when a part of the cleaning housing 70H comes in between the light emitting part and the light receiving part of the second detection sensor 804, the second detection sensor 804 detects the cleaning unit 70.

The unit drive output gear 805 transmits a rotational drive force generated by the motor of the unit driving unit 80 to the rotation input gear 40G of the cleaning unit rotating unit 45. In the present embodiment, when the conveyance unit frame 40H is mounted on the body frame 100, the rotation input gear 40G and the unit drive output gear 805 engage with each other, which allows transmission of the rotational drive force to the rotary shaft 451.

[Mechanism for Mounting Cleaning Unit]

Figure 17:
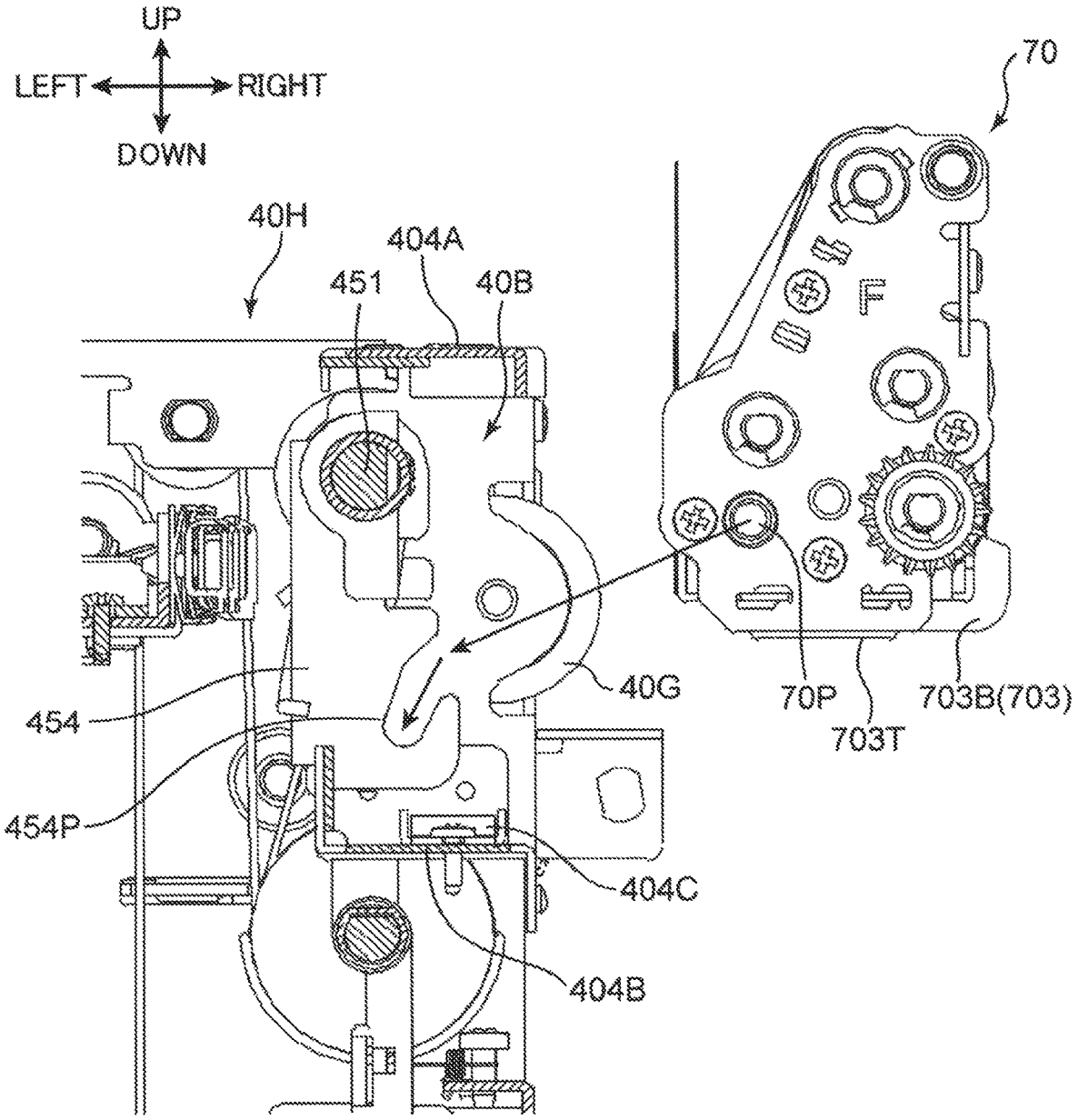
FIG. 17 is a cross-sectional view showing a state where the cleaning unit is about to be mounted on the conveyance unit frame.
Figure 18:
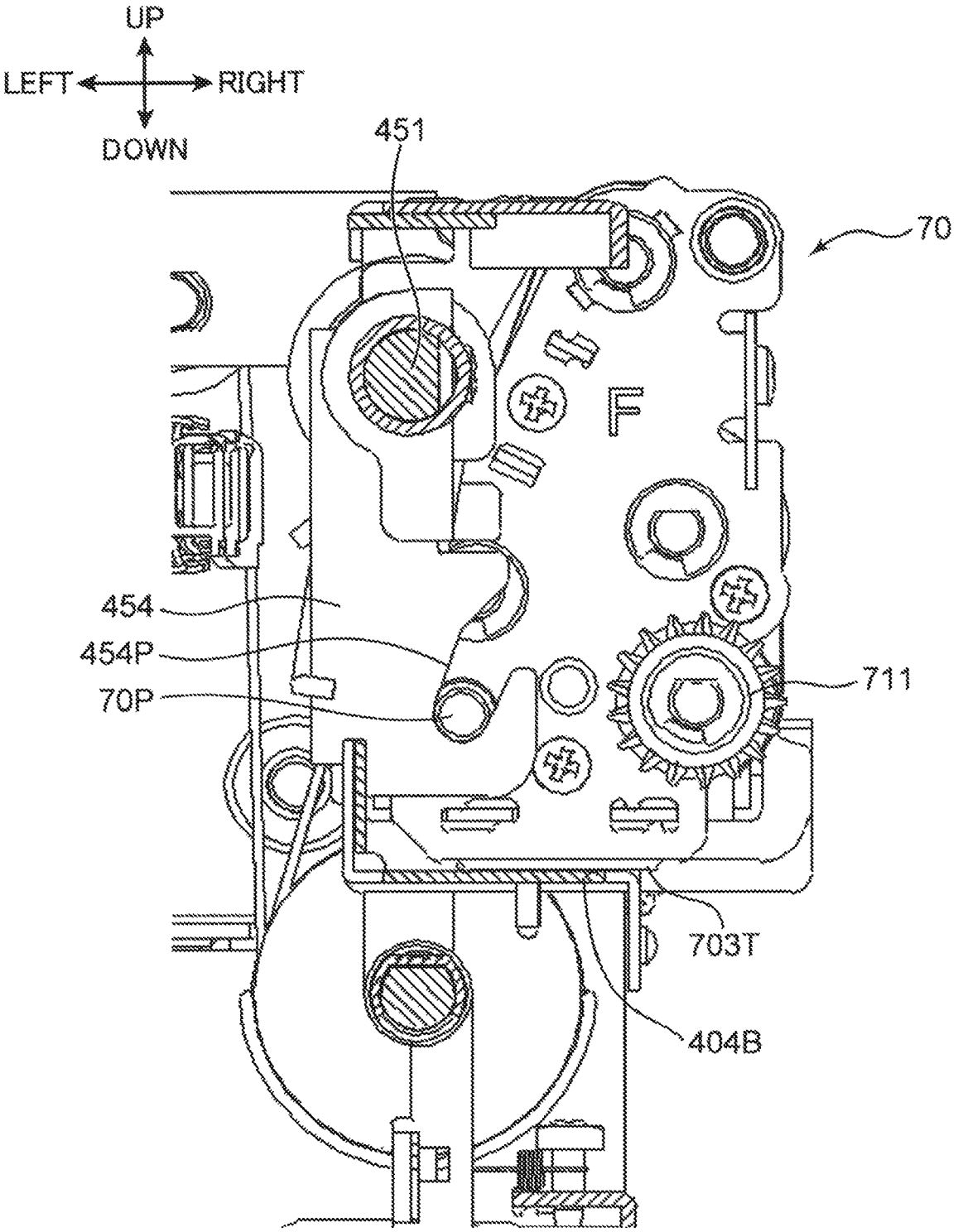
FIG. 18 is a cross-sectional view showing a state where the cleaning unit is mounted on the conveyance unit frame.
Figure 20:
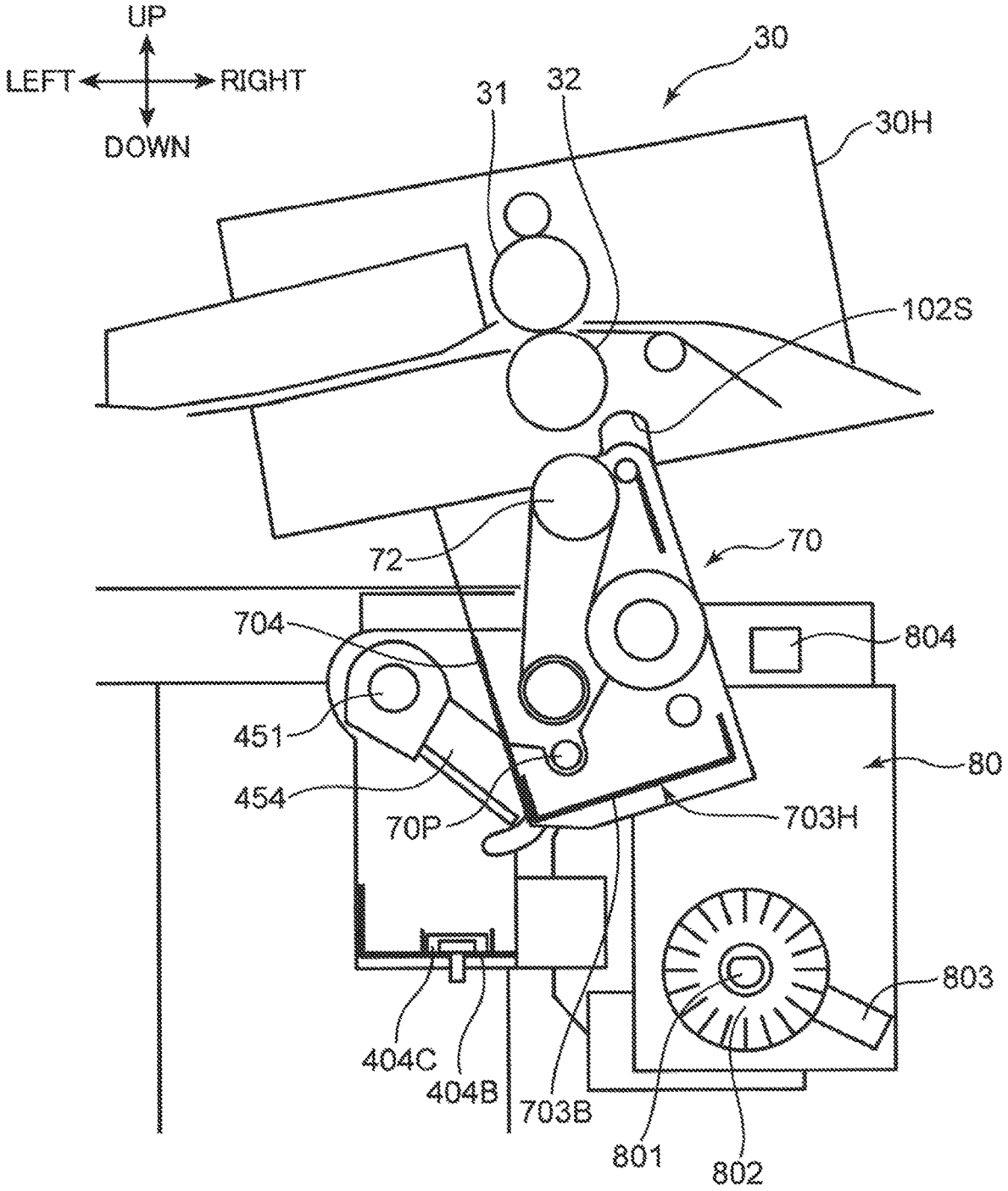
FIG. 20 is a cross-sectional view of the pair of resist rollers, the cleaning unit, and their surroundings, showing a state where the cleaning unit is located at a separation position.

FIG. 17 is a cross-sectional view showing a state where the cleaning unit 70 is about to be mounted on the conveyance unit frame 40H, and FIG. 18 is a cross-sectional view showing a state where the cleaning unit 70 is mounted on the conveyance unit frame 40H. FIG. 19 is a cross-sectional view of the resist roller unit 30, the cleaning unit 70, and their surroundings, showing a state where the cleaning unit 70 is located at the mounting and removing position, and FIG. 20 is a cross-sectional view showing a state where the cleaning unit 70 is located at the separation position.

As shown in FIG. 19, the movement mechanism 75 has a guide portion 100G. The guide portion 100G allows the pair of guide rollers 705 to be brought into contact with the guide portion 100G along with the rotation of the pair of rotary levers 454, and guide the cleaning unit 70 between the cleaning position and the mounting and removing position. The guide portion 100G have a pair of front and rear first guide surfaces 101R and a pair of front and rear second guide surfaces 102R. The pair of front and rear first guide surfaces 101R are formed of left side surfaces of a pair of front and rear guide frames 101 included in the body frame 100, respectively. The first guide surface 101R is inclined such that the first guide surface 101R guides the cleaning unit 70 (guide roller 705) rightward as the first guide surface 101R extends upward. The pair of front and rear second guide surfaces 102R are each formed of the resist housing 30H. The second guide surface 102R is slightly inclined such that the second guide surface 102R guides the cleaning unit 70 (guide roller 705) leftward as the second guide surface 102R extends upward.

The movement mechanism 75 further has a pair of front and rear positioning portions 102S. The positioning portion 102S is brought into contact with the guide roller 705 of the cleaning unit 70 at the cleaning position and thus positioning the cleaning unit 70 such that the web W of the cleaning part 70A can clean the resist lower roller 32. As shown in FIG. 19, the positioning portion 102S is connected to the second guide surface 102R, and has an arc shape that extends along an outer peripheral surface of the guide roller 705. In FIG. 19, out of the pairs of front and rear first guide surfaces 101R, front and rear second guide surfaces 102R, and front and rear positioning portions 102S, the rear first guide surface 101R, the rear second guide surface 102R, and the rear positioning portion 102S are shown.

As shown in FIG. 12, when the conveyance unit frame 40H is pulled out frontward from the body frame 100, an operator can mount the cleaning unit 70 on the cleaning unit mounting portion 40B (FIGS. 14 and 15) of the conveyance unit frame 40H. As shown in FIG. 17, the pair of rotary levers 454 are disposed so as to extend downward from the rotary shaft 451, and each pin receiving portion 454P is formed on each rotary lever 454 by slantly cutting out its right side in a leftward and downward direction. Because of this configuration, when mounting the cleaning unit 70, the operator can insert and fit the pair of front and rear unit fulcrum pins 70P of the cleaning unit 70 into the pin receiving portions 454P from above while holding the side wall 703A and the bottom wall 703B (FIGS. 6A and 6B) of the cleaning unit 70 (FIG. 18). At this stage of the operation, the above-described unit input gear 711 is disposed behind the front unit fulcrum pin 70P. The rear unit fulcrum pin 70P is fitted into the pin receiving portion 454P.

When the pair of unit fulcrum pins 70P are fitted in the pin receiving portions 454P by the operator, the bottom wall 703B of the cleaning housing 70H is disposed so as to face the pair of magnets 404C, and a pair of ribs 703T are each brought into contact with the upper surface portion of the second right frame 404B. As a result, in addition to the pair of rotary levers 454, the cleaning unit 70 is held by the second right frame 404B by a magnetic field generated by the pair of magnets 404C. Thus, even when the operator leaves his or her hand from the cleaning unit 70, the cleaning unit 70 is prevented from coming off from the conveyance unit frame 40H.

When the cleaning unit 70 is mounted on the cleaning unit mounting portion 40B (mounting and removing position) of the conveyance unit frame 40H, the operator inserts the conveyance unit frame 40H into the body frame 100 (FIG. 13). As a result, the cleaning unit 70 is inserted in the body frame 100 as the rotation input gear 40G of the conveyance unit frame 40H engages with the unit drive output gear 805 of the unit driving unit 80 in the body frame 100. At this stage of the operation, the pair of front and rear guide rollers 705 of the cleaning unit 70 is disposed so as to face the first guide surfaces 101R of the pair of front and rear guide portions 100G at predetermined intervals in the left-right direction.

As shown in FIG. 19, when the cleaning unit 70 disposed at the mounting and removing position is viewed from a direction parallel to the axial direction of the resist lower roller 32, a center (P2) of the unit fulcrum pin 70P supported by the pin receiving portion 454P is disposed below and right with respect to a center axis (P1) of the rotary shaft 451. A center of gravity (J) of the cleaning unit 70 is disposed right with respect to the unit fulcrum pin 70P. In the present embodiment, the pressing roller 72 includes the heavy pressing roller shaft 72S made of a metal material. In view of this fact, the center of gravity (J) of the cleaning unit 70 is located offset to be on a right side portion of the cleaning unit 70 so as to be positioned right with respect to a center (P4) of the pressing roller 72. Further, a center (P3) of the magnet 404C in the left-right direction is disposed right with respect to the center (P2) of the unit fulcrum pin 70P.

In the state shown in FIG. 19, the rotary shaft 451 of the cleaning unit rotating unit 45 is rotated by a drive force of the unit driving unit 80, and this rotation of rotary shaft 451 causes the pair of rotary levers 454 to rotate counterclockwise. At this stage of the operation, a left end portion of the bottom wall 703B moves upward along with the movement of the unit fulcrum pin 70P. As a result of this movement, a distance between the left end portion of the bottom wall 703B and the magnet 404C is increased, and, consequently, an effect of a magnetic restraining force generated by the magnet 404C becomes small. Thus, the bottom wall 703B of the cleaning unit 70 can be easily removed from the magnet 404C. Then, when the cleaning unit 70 is tilted rightward about the unit fulcrum pin 70P due to its own weight, the pair of guide rollers 705 is brought into contact with the first guide surfaces 101R of the pair of guide portions 100G respectively.

Thereafter, when the pair of rotary levers 454 further rotate corresponding to the rotation of the rotary shaft 451, the cleaning unit 70 moves upward and rightward as the pair of guide rollers 705 are guided by the first guide surfaces 101R. At this stage of operation, a rotation trajectory of the rotary lever 454 and a movement trajectory of the cleaning unit 70 guided by the first guide surface 101R are different from each other. In the present embodiment, the pair of unit fulcrum pins 70P of the cleaning unit 70 is supported by the pin receiving portion 454P of the rotary lever 454 so as to be rotatable relative to the pin receiving portion 454P. Accordingly, the orientation of the cleaning unit 70 can be changed along with the upward movement of the cleaning unit 70 and hence, the cleaning unit 70 can smoothly rise corresponding to the rotation of the rotary lever 454.

In the state shown in FIG. 20, the pair of guide rollers 705 (FIGS. 3 and 4) are transferred from the first guide surfaces 101R to the second guide surfaces 102R. Then, when the pair of rotary levers 454 further rotates corresponding to the rotation of the rotary shaft 451, the pair of guide rollers 705 is brought into contact with and is fitted in the pair of positioning portions 102S. At this stage of the operation, as shown in FIG. 2, the pressing roller 72 of the cleaning part 70A of the cleaning unit 70 is brought into contact with the resist lower roller 32 from below along the straight line L which connects the center of the resist upper roller 31 and the center of the resist lower roller 32 to each other.

When the cleaning unit 70 is disposed at the cleaning position shown in FIG. 2 in this manner, the pressing roller 72 presses the web W against the resist lower roller 32. This brings the contact surface WA of the web W into contact with the surface of the resist lower roller 32, creating a state where paper dust, ink, and the like adhering to the surface of the resist lower roller 32 can be removed. In the orientation of the cleaning unit 70 disposed at the cleaning position shown in FIG. 2, the center of gravity (the pressing roller 72) of the cleaning unit 70 is disposed just above the unit fulcrum pin 70P and hence, the orientation of the cleaning unit 70 at the cleaning position can be maintained in a stable manner.

In the present embodiment, the first detection sensor 803 detects an amount of rotation of the pulse plate 802 with respect to the mounting and removing position shown in FIG. 19 that is defined as a reference position. Through this process, an amount of rotation of the rotary levers 454, that is, the position of the cleaning unit 70 (cleaning position, separation position) is detected. When the second detection sensor 804 detects the cleaning housing 70H, it is detected that the cleaning unit 70 has reached the cleaning position.

[Operation of Cleaning Unit]

Figure 21:
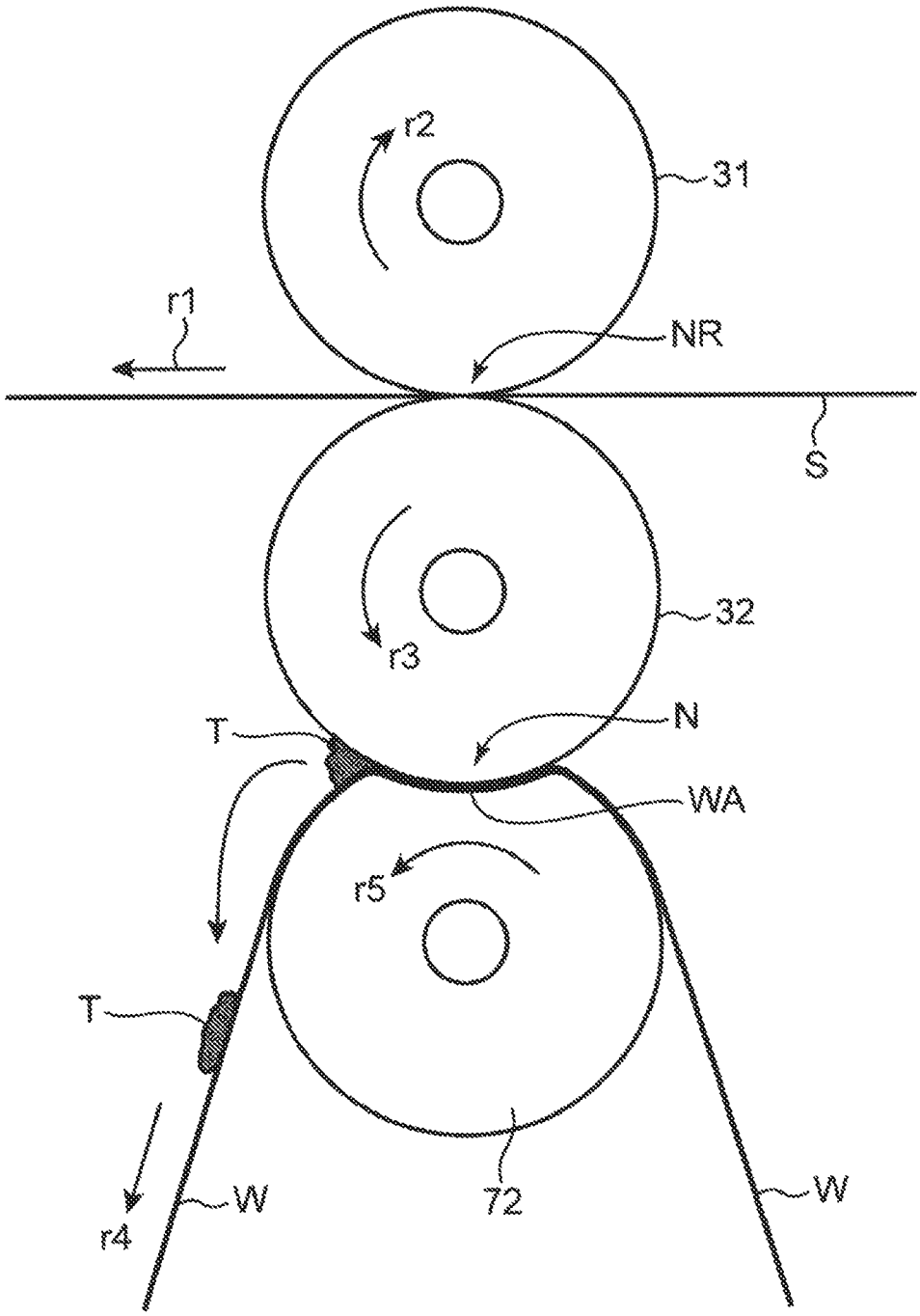
FIG. 21 is a schematic view for explaining a basic operation of the pair of resist rollers and the cleaning unit.

FIG. 21 is a schematic view for explaining a cleaning operation by the cleaning unit 70 to clean the resist lower roller 32. The sheet S is fed through a resist nip portion NR formed by the resist upper roller 31 and the resist lower roller 32 and is conveyed in a direction of arrow r1. To convey the sheet S in the direction of arrow r1, as shown in FIG. 21, the resist upper roller 31 rotates in a direction of arrow r2, i.e., the clockwise direction, while the resist lower roller 32 rotates in a direction of arrow r3, i.e., the counterclockwise direction.

The web W of the cleaning unit 70 comes in contact from below with the resist lower roller 32. As described above, when the both-side printing is carried out on the sheet S, the sheet S having been subjected to the single-side printing is reversed to have its front and back surfaces switched to each other, and is conveyed into the resist nip portion NR. At this stage of operation, the surface of the resist lower roller 32 comes in contact with the printed surface of the sheet S, which causes ink to adhere to the surface of the resist lower roller 32 in some cases. The sheet S fed through the resist nip portion NR causes paper dust to rise, which adheres to the surface of the resist lower roller 32 in some cases. The web W wipes foreign matter T, such as ink and paper dust mentioned above, away from the surface of the resist lower roller 32.

The web W is put over the pressing roller 72 disposed in the midpoint between the web driven roller 71 and the web drive roller 73 and is pressed against the surface of the resist lower roller 32 by the pressing roller 72. In other words, the contact surface WA, on which the web W comes in contact with the surface of the resist lower roller 32, is formed as a result of the web W being nipped in the web nip portion N created by pressing the pressing roller 72 against the resist lower roller 32. Because the pressing roller 72 is more elastic than the resist lower roller 32, the surface of the pressing roller 72 dents in at the web nip portion N. By adjusting an extent of denting of the pressing roller 72 (pressure contact force applied to the resist lower roller 32), a width of the web nip portion N, that is, a width of the contact surface WA can be adjusted.

By the web feed-out mechanism 81 (solenoid 811), the web W is fed intermittently in a direction of arrow r4, i.e., direction of heading toward the web drive roller 73. When the web W is fed in the direction of arrow r4, the pressing roller 72, which is in contact with the back surface of the web W, is driven to rotate in a direction of arrow r5, i.e., the counterclockwise direction. As a result, the web drive roller 73 takes up the web W such that the direction of taking up the web W (arrow r4) is the reverse direction with respect to a normal rotation direction (arrow r3) of the resist lower roller 32 that conveys the sheet S in the direction of arrow r1.

When the foreign matter T adheres to the surface of the resist lower roller 32 at the resist nip portion NR or its vicinity, the foreign matter T moves toward the web nip portion N along with the rotation of the resist lower roller 32 in the direction of arrow r3. The foreign matter T usually cannot pass through the web nip portion N, and is therefore blocked and piles up on an upstream side of the web nip portion N in the direction of rotation of the resist lower roller 32. FIG. 21 shows the piled up foreign matter T.

The web W comes to stop for a predetermined time in a suspension period during the above intermittent feeding of the web W. In this suspension period, the contact surface WA formed on the web nip portion N comes in contact with the surface of the rotating resist lower roller 32 to clean the surface. Afterward, when the web W is fed in the direction of arrow r4 during a movement period in the above intermittent feeding, a new contact surface WA comes in contact with the surface of the resist lower roller 32 and performs the cleaning. As the web W is fed in the direction of arrow r4, the foreign matter T piling up near the web nip portion N is carried by the surface of the web W and is moved downstream in the take-up direction of the web W. The foreign matter T, together with the web W having been used for the cleaning, is thus taken up by the web drive roller 73. Even if the foreign matter T drops from the vicinity of the web nip portion N or the surface of the web W, the foreign matter T ends up being collected in the cleaning housing 70H, which process will be described below.

[Collecting Foreign Matter by Cleaning Housing]

Figure 22:
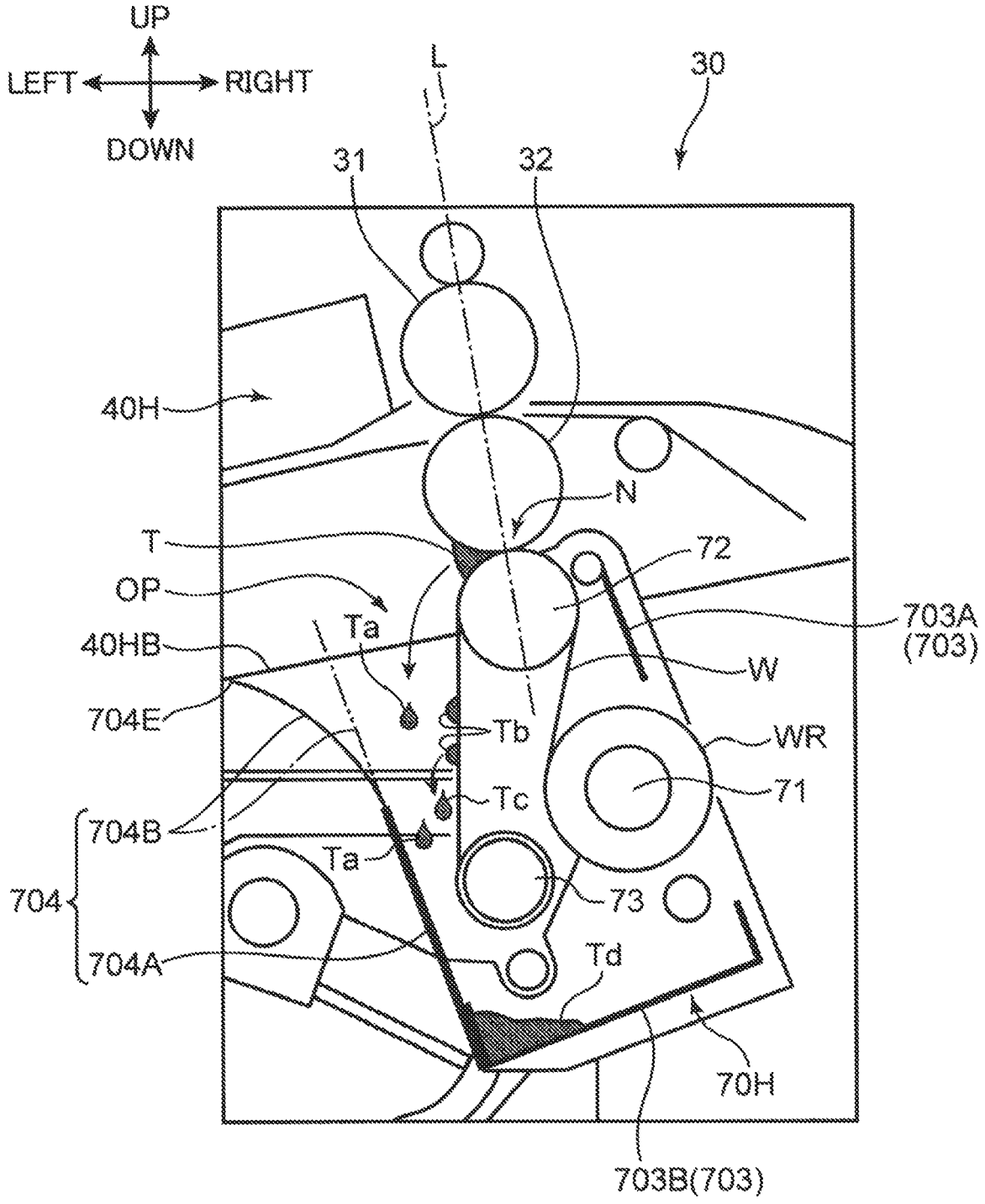
FIG. 22 is an enlarged cross-sectional view of a principle part of the components shown in FIG. 2, showing a state where foreign matter drops into a cleaning housing to be collected therein.

FIG. 22 is an enlarged cross-sectional view of a principle part of the components shown in FIG. 2, showing a state where the foreign matter T drops into the cleaning housing 70H to be collected therein. The foreign matter T, which is wiped away by the web W from the surface of the resist lower roller 32 and is blocked in the vicinity of the web nip portion N, may drop when the foreign matter T piles up heavily or the apparatus body 10 vibrates due to an unknown reason. Such dropping foreign matter Ta is shown in FIG. 22. The dropping foreign matter Ta, however, is received by the cleaning housing 70H having the box structure, and therefore does not scatter in the apparatus body 10.

The cleaning housing 70H has the sheet member 704 disposed so as to face the web nip portion N across the opening OP. The sheet member 704, together with the front wall 701, the rear wall 702, and the connection wall 703 including the side wall 703A and the bottom wall 703B, jointly forms the box structure having the opening OP on its top surface. The web nip portion N lies on the straight line L connecting the center of the resist upper roller 31 to the center of the resist lower roller 32. As described above, the straight line L is inclined against the vertical direction at an acute angle. The direction of extension of the sheet member 704 from the bottom wall 703B is inclined further against the vertical direction than the straight line L is.

When the foreign matter T drops from the vicinity of the web nip portion N in the form of the dropping foreign matter Ta because of the weight of the foreign matter T or vibrations, therefore, the dropping foreign matter Ta passes through the opening OP to enter the cleaning housing 70H. The dropping foreign matter Ta then hits the sheet member 704 and the like to land on the bottom wall 703B. Hence scattering of the foreign matter Tin the apparatus body 10 is prevented. In this manner, the cleaning housing 70H, whose original function is to support the cleaning part 70A, functions also as a collection box for collecting the foreign matter T. This makes providing a separate collection box unnecessary, thus achieving space-saving in the image forming apparatus 1 and a reduction in the number of components.

Foreign matter Tb carried by the web W having been used at the web nip portion N is taken up together with the web W, by the web drive roller 73. There may be a case where the foreign matter T carried by the web W drops therefrom in the form of foreign matter Tc due to the weight of the foreign matter T or vibrations. In the present embodiment, however, the sheet member 704 is disposed so as to face the web W supported in an extended manner between the pressing roller 72 and the web drive roller 73. In other words, the sheet member 704 is set opposite to the web W located downstream to the web nip portion N, that is, the web W having come in contact with the resist lower roller 32 and cleaned its surface. The dropping foreign matter Tc from the web W is, therefore, also caused to land in the cleaning housing 70H to be certainly collected therein.

As a result of collection of the dropping foreign matter Ta and Tc, collected foreign matter Td piles up on the bottom wall 703B of the cleaning housing 70H. When the web W rolled around the web driven roller 71 as a roll of the web W to be used, i.e., the web roll WR is used up, the entire cleaning unit 70 is replaced. Specifically, as shown in FIG. 12, the conveyance unit frame 40H is pulled forward to remove the cleaning unit 70 including the used web W. This operation takes the collected foreign matter Td, together with the cleaning housing 70H, out of the body frame 100. This means that replacement of the cleaning unit 70 and collection of the foreign matter Td can be completed through one operation.

The sheet member 704 is attached to the bottom wall 703B so as to extend upward, and is formed by joining together the thick-walled film 704A on the lower side and the thin-walled film 704B on the upper side. The sheet member 704 thus has the lower part with relatively higher rigidity and the upper part with relatively lower rigidity. Having this property, the sheet member 704 can be bent when the cleaning unit 70 is mounted in the apparatus body 10. Specifically, as the thick-walled film 704A maintains the rigidity of the box structure, the thin-walled film 704B can be bent to widen the opening OP into a funnel shape.

FIG. 22 shows a state where, at the cleaning unit 70 set in the cleaning position, the upper edge 704E of the sheet member 704 comes in contact with a frame lower part 40HB of the conveyance unit frame 40H and consequently the thin-walled film 704B only bents convexly upward. As a result, the opening OP comes to have a larger opening width, which makes it easier for the cleaning housing 70H to receive the incoming dropping foreign matter Ta and Tc. The upper edge 704E coming in contact with the frame lower part 40HB forms a seal structure, which prevents paper dust from flying out of the cleaning housing 70H.

MODIFICATIONS

The embodiment of the present disclosure has been described above. The present disclosure is, however, not limited to this embodiment but may be embodied, for example, as the following modified embodiments.

(1) The above embodiment has been described to show an example in which the box structure of the cleaning housing 70H is formed of the front wall 701, the rear wall 702, the connection wall 703 including the side wall 703A and the bottom wall 703B, and the sheet member 704. This is one example of the box structure, and the sheet member 704 may be formed not of a film but of, for example, a sheet metal or resin plate.

(2) The above embodiment has been described to show an example in which the conveyance roller to be cleaned by the cleaning unit 70 is the resist lower roller 32 of the resist roller unit 30. The conveyance roller to be cleaned, however, may be a different roller that conveys the sheet S.

(3) The above embodiment has been described to show a mode in which the image forming unit 50 adopts an ink jet method. The image forming unit 50, however, may adopt a different image forming method, such as a known electrophotographic method.

The present disclosure described above can provide a cleaning device that can easily and certainly collect paper dust or the like wiped way by a web from a conveyance roller that conveys a sheet, and an image forming apparatus to which the cleaning device is applied.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A cleaning device capable of cleaning a surface of a conveyance roller that conveys a sheet in an image forming apparatus, the cleaning device comprising:

a cleaning unit including:

a cleaning part having a contact surface extending along an axial direction of the conveyance roller, the contact surface being brought into contact with the surface of the conveyance roller to clean the surface of the conveyance roller; and a housing that supports the cleaning part, wherein the cleaning part includes:

a web of a strip shape, the web forming the contact surface that comes in contact with the conveyance roller;

a pressing roller that presses the web against the conveyance roller;

a feed-out roller that feeds out the web so as to cause a part of the web that comes in contact with the conveyance roller to shift; and a take-up roller that takes up the web, and the housing has a box structure having an opening that receives foreign matter dropping from a vicinity of a nip portion formed between the pressing roller and the conveyance roller, and wherein the housing includes:

a pair of wall portions that support both ends of respective roller shafts of the pressing roller, the feed-out roller, and the take-up roller;

a bottom wall disposed below the cleaning part; and a sheet member disposed so as to face a nip portion between the pressing roller and the conveyance roller across the opening, the sheet member, together with the pair of wall portions and the bottom wall, jointly forming the box structure.

2. The cleaning device according to claim 1, wherein the sheet member is disposed so as to face a web supported in an extended manner between the pressing roller and the take-up roller.

3. The cleaning device according to claim 1, wherein the sheet member is attached to the bottom wall so as to extend upward, and has a lower part with predetermined first rigidity and an upper part with second rigidity lower than the first rigidity, and the opening is formed between the pressing roller and an upper edge of the upper part.

4. The cleaning device according to claim 3, wherein the lower part and the upper part are films having different thicknesses but being made of a same material, the lower part is a thick-walled film having a first thickness, and the upper part is a thin-walled film having a second thickness smaller than the first thickness.

5. An image forming apparatus comprising:

an apparatus body;

a conveyance roller that conveys a sheet;

an image forming unit that forms an image on the sheet; and the cleaning device according to claim 1 configured to clean the conveyance roller.

6. The image forming apparatus according to claim 5, further comprising:

an upper resist roller that conveys the sheet toward the image forming unit at timing matching timing of image forming at the image forming unit, wherein the conveyance roller is a lower resist roller that is disposed under the upper resist roller to form a nip portion between the lower resist roller and the upper resist roller, the nip portion allowing the sheet to travel therethrough, and that conveys the sheet toward the image forming unit at timing matching the timing of image forming, and the cleaning device cleans up a surface of the lower resist roller.

7. The image forming apparatus according to claim 5, further comprising:

a conveyance unit including a conveyance portion that conveys the sheet at a position different from a position of the conveyance roller, the conveyance unit being configured to be mounted on the apparatus body along a first direction parallel to the axial direction and be removed from the apparatus body along a second direction reverses to the first direction, wherein the conveyance unit includes a unit housing portion in which the cleaning unit is housed, and the cleaning unit is configured to be mounted and removed together with the conveyance unit, on and from the apparatus body.

* * * * *